US005903291A

United States Patent [19]

Yoshimura et al.

[11] Patent Number: 5,903,291

[45] Date of Patent: May 11, 1999

[54] INK JET HEAD UTILIZING ELECTROVISCOUS FLUID FOR CONTROL OF INK DISCHARGE

[75] Inventors: Hisashi Yoshimura; Kouichi Irihara; Kohji Tsurui; Hiroshi Kubota; Kazuya Koyama; Hajime Horinaka, all of Nara; Masaharu Kimura, Osaka, all of Japan

[73] Assignee: Sharp Kabushiki Kaisha, Osaka, Japan

[21] Appl. No.: 08/711,946

[22] Filed: Sep. 4, 1996

[30] Foreign Application Priority Data

| | | | |
|---|---|---|---|
| Sep. 4, 1995 | [JP] | Japan | 7-226649 |
| Feb. 1, 1996 | [JP] | Japan | 8-016784 |
| Feb. 21, 1996 | [JP] | Japan | 8-033605 |

[51] Int. Cl.[6] ..... B41J 2/485

[52] U.S. Cl. ..... 347/48; 347/54

[58] Field of Search ..... 347/48, 55, 54

[56] References Cited

U.S. PATENT DOCUMENTS

| | | | |
|---|---|---|---|
| 3,553,708 | 1/1971 | Carreira et al. | 347/55 |
| 3,946,398 | 3/1976 | Kyser et al. | 347/70 |
| 4,024,544 | 5/1977 | Vernon | 347/54 |
| 4,480,259 | 10/1984 | Kruger et al. | 347/48 |

FOREIGN PATENT DOCUMENTS

| | | |
|---|---|---|
| 57-75866 | 5/1982 | Japan . |
| 63-151459 | 6/1988 | Japan . |
| 2-169253 | 6/1990 | Japan . |
| 2-172746 | 7/1990 | Japan . |
| 3-43253 | 2/1991 | Japan . |

*Primary Examiner*—Benjamin R. Fuller
*Assistant Examiner*—Christina Annick

[57] ABSTRACT

An ink jet head includes an electroviscous fluid chamber provided at a part of a sidewall of an ink chamber, and having electroviscous fluid sealed therein, an elastic film provided between the ink chamber and the electroviscous fluid chamber for transmitting pressure between the ink chamber and the electroviscous fluid chamber, a pair of electrodes provided at a part of a sidewall of the electroviscous fluid chamber corresponding to the ink chamber for applying an electric field to the electroviscous fluid, a pressure generation device for discharging ink from the ink chamber, and a control device for controlling ink discharge by applying a voltage to the pair of electrodes to alter the viscosity of the electroviscous fluid in response to record information.

49 Claims, 24 Drawing Sheets

NOT ACTUATED

ACTUATED

INK JET HEAD UTILIZING ELECTROVISCOUS FLUID FOR CONTROL OF INK DISCHARGE

BACKGROUND OF THE INVENTION

1. Field of the Invention

The present invention relates to ink jet heads of ink jet printers, and more particularly, to an ink jet head utilizing electroviscous fluid for control of ink discharge.

2. Description of the Background Art

A typical conventional ink jet head forming an image by discharging droplets of recording liquid is called a XEYSER type ink jet head, and is disclosed in U.S. Pat. No. 3,946,398. According to this head, an electric signal is applied to a piezo oscillator attached to a recording head including an orifice to reduce the volume within an ink chamber, whereby pressure is generated to discharge ink. This head must have a plurality of piezo oscillators attached corresponding to each of a plurality of discharge channels. It is difficult to reduce the size of a piezo oscillator. Therefore, this head had a problem that down-sizing is difficult and print out at high density was inhibited.

In order to solve the above problem, Japanese Patent Laying-Open No. 2-172746 discloses a head that utilizes electroviscous fluid for controlling ink discharge. Here, this electroviscous fluid is a liquid having dielectric solid particles and dielectric compounds dispersed within an electrical insulative liquid, and exhibits the Winslow effect in which the viscosity is altered suddenly by having a voltage applied.

FIG. 1 is a schematic diagram of a conventional ink jet head utilizing electroviscous fluid for control of ink discharge. Referring to FIG. 1, an ink jet head includes a main body 529 with a cavity 526 for accommodating recording liquid 527 which is a mixture of ink and electroviscous fluid. Main body 529 includes sidewall pairs of 528A, 528B, . . . , 528E, each forming channel nozzles 522A, 522B, . . . 522E with orifices 521A, 521B, . . . , 521E for discharging droplets 523, a piezo-electric element provided within cavity 526 for generating a pressure wave to recording liquid 527, and control electrode pairs 524A, 524B, . . . 524E provided at respective sides of orifices 521A, 521B, . . . 521E for applying an electric field to recording liquid 527.

The pressure generated within cavity 526 by the deflection deformation of piezo oscillator 525 is conveyed to recording liquid 527 including ink mixed with electroviscous fluid. Recording liquid 527 arrives at each of channel nozzles 522A–522E to be discharged from orifices 521A–521E as droplets 523. Control electrodes 524A–524E in the proximity of the orifices apply a voltage to recording liquid 527 in a non-recording channel, whereby the viscosity of ink in the proximity of the orifice is increased to prevent discharge.

According to this technique, the recording head can be formed of a plurality of piezo oscillators fewer in number than the ink discharge channels. Therefore, reduction in size of the recording head and print out at high density can be realized.

However, this technique has the following problems since the electroviscous fluid per se is used as the recording liquid. In other words, the electroviscous fluid is mixed with ink and consumed. Therefore, the characteristics as electroviscous fluid and the characteristics as ink both must be achieved. It is for this reason that the characteristics as ink becomes unstable. As a result, clogging occurs to prevent printing of a favorable quality. Degradation in the dispersibility of the colorant causes generation of precipitation and clogging. Also, the colorant adheres to the electrode by application of a voltage to the recording liquid. Furthermore, the running cost of the recording liquid is high since the electroviscous fluid is consumed together with the ink.

SUMMARY OF THE INVENTION

An object of the present invention is to provide an ink jet head utilizing electroviscous fluid for control of ink discharge, and that can print out at a favorable quality Another object of the present invention is to provide an ink jet head utilizing electroviscous fluid for control of ink discharge, and that can print out using a recording liquid of favorable characteristics.

A further object of the present invention is to provide an ink jet head utilizing electroviscous fluid for control of ink discharge, and that can use ink and electroviscous fluid in a separated manner.

Still another object of the present invention is to provide an ink jet head utilizing electroviscous fluid for control of ink discharge, and that can print out at low cost without difference in printing density over a large area of printing.

A still further object of the present invention is to provide an ink jet head utilizing electroviscous fluid for control of ink discharge, and that can print out at a higher density.

Still a further object of the present invention is to provide a smaller ink jet head utilizing electroviscous fluid for control of ink discharge.

Yet a further object of the present invention is to provide an ink jet head utilizing electroviscous fluid for control of ink discharge, and that can use recording liquid of a lower running cost.

Yet another object of the present invention is to provide an ink jet head utilizing electroviscous fluid for control of ink discharge, and that can use a recording liquid that does not have to be combined with electroviscous fluid.

Yet a still further object of the present invention is to provide an ink jet head utilizing electroviscous fluid for control of ink discharge, and that has few breakdowns.

An additional object of the present invention is to provide an ink jet head utilizing electroviscous fluid for control of ink discharge, and that can use a recording liquid of favorable characteristics during a discharge operation.

Another additional object of the present invention is to provide an ink jet head utilizing electroviscous fluid for control of ink discharge, and that can use a recording liquid that does not include electroviscous fluid.

Still another additional object of the present invention is to provide an ink jet head utilizing electroviscous fluid for control of ink discharge, and that has a uniform discharge pressure.

According to an aspect of the present invention, an ink jet head includes an ink chamber with an orifice to discharge ink, an ink supply path for supplying ink to the ink chamber, an electroviscous fluid chamber provided at a part of a sidewall of the ink chamber, and sealed with electroviscous fluid, an elastic film provided between the ink chamber and the electroviscous fluid chamber for transmitting pressure between the ink chamber and the electroviscous fluid chamber, a pair of electrodes provided at a part of a sidewall of the electroviscous fluid chamber corresponding to the ink chamber for applying an electric field to the electroviscous fluid, a pressure generation device for generating a pressure to discharge ink from the ink chamber, and a control device responsive to record information to apply a voltage to alter the viscosity of the electroviscous fluid for controlling ink discharge from the orifice.

The pressure generation device generates pressure for discharging ink from the ink chamber. When the control device applies a voltage to the electrode in response to record information, the viscosity of the electroviscous fluid is modified. This change in viscosity causes variation in the level of transmittance of pressure via the elastic film between the ink chamber and the electroviscous fluid chamber, whereby control is provided of ink discharge from the orifice.

Therefore, discharge of ink from the orifice can be controlled by the electroviscous fluid completely isolated from the ink. More specifically, the ink does not have to be mixed with the electroviscous fluid. A recording liquid of favorable characteristics can be used for the ink per se without sustaining the constraint of the characteristics as the electroviscous fluid.

As a result, printing in favorable quality can be carried out. The head does not consume the electroviscous fluid per se. Therefore, the running cost of the head is lower than the case where a recording liquid which is a combination of ink and electroviscous fluid is used. Furthermore, clogging, precipitation, and adhesion of a colorant encountered in the case where a recording liquid having ink and electroviscous liquid combined is used does not occur.

Preferably, the ink jet head includes a plurality of ink chambers, and a plurality of electrode pairs provided corresponding to the plurality of ink chambers. The ink supply path supplies ink to the plurality of ink chambers. The control device controls each pair of electrodes individually.

The ink jet head can further include an ink pressure chamber for supplying ink from the ink supply path to the plurality of ink chambers. The pressure generation device is provided adjacent to the ink pressure chamber for generating a pressure wave to the ink within the ink pressure chamber. The control device responds to record information to control the plurality of pairs of electrodes individually, whereby the viscosity of the electroviscous fluid is altered. The pressure wave generated in the ink pressure chamber is reflected or absorbed by the electroviscous fluid, whereby ink discharge from the orifice of the plurality of ink chambers is controlled.

By the pressure generation device provided common to the plurality of ink chambers, ink discharge from the orifice of the plurality of ink chambers can be controlled. As a result, the head can be reduced in size, and print out can be carried out at a favorable quality.

The pressure generation device can be provided adjacent to the electroviscous fluid chamber to generate a pressure wave to the electroviscous fluid within the electroviscous fluid chamber. The control device responds to the record information to control the plurality of electrode pairs individually to alter the viscosity of the electroviscous fluid. The pressure wave generated in the electroviscous fluid chamber is transmitted or cut off by the electroviscous fluid to control ink discharge from the orifice of the plurality of ink chambers.

The electroviscous fluid chamber can include a pressure absorption unit provided at the side of the electroviscous fluid chamber not in contact with the ink chamber for absorbing the pressure wave generated at the electroviscous fluid chamber or the ink chamber that was absorbed by the electroviscous fluid.

The pressure absorption unit of the electroviscous fluid chamber can absorb the pressure wave generated at the electroviscous fluid chamber or the ink chamber that was absorbed by the electroviscous fluid. By absorbing the pressure wave corresponding to an ink chamber that does not discharge ink by the pressure absorption unit, ink can be discharged under a uniform pressure independent of the number of non-discharging heads.

The ink jet head can further include a generation pressure adjustment device for adjusting the level of the pressure wave generated by the pressure generation device according to record information.

The generation pressure adjustment device provides adjustment so that the generated pressure wave is smaller when the number of ink chambers that do not discharge ink is great. Therefore, ink can be discharged at uniform pressure independent of the number of non-discharging heads.

According to another aspect of the present invention, an ink jet head can include a plurality of electroviscous fluid chambers provided corresponding to the plurality of ink chambers. The electrode included in each of the plurality of electrode pairs is provided at a wall of the plurality of electroviscous fluid chambers opposite to the side adjacent to the plurality of ink chambers. The pressure generation chamber is provided at an opposite side to the plurality of ink chambers about the plurality of electroviscous fluid chambers. The plurality of ink chambers and the plurality of electroviscous fluid chambers corresponding to the plurality of ink chambers are arranged in a two-dimensional matrix. The pressure generation device can include a roller for applying pressure to the electroviscous fluid.

The roller provided at the opposite side to the plurality of ink chambers about the plurality of electroviscous fluid chambers applies pressure to the electroviscous fluid in the plurality of electroviscous fluid chambers. The electroviscous fluid in the plurality of electroviscous fluid chambers arranged in a two-dimensional matrix is pressurized in a more uniform manner by the roller.

As a result, difference in printing density does not occur with respect to a large print out area. Print out can be effected at a favorable quality. The roller is more economic than an electrical device so that the cost of ink jet head can be reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

First Embodiment

An ink jet head according to a first embodiment of the present invention has pressure applied to the ink in an ink chamber, and electroviscous fluid used for control of ink discharge.

Figure 1:
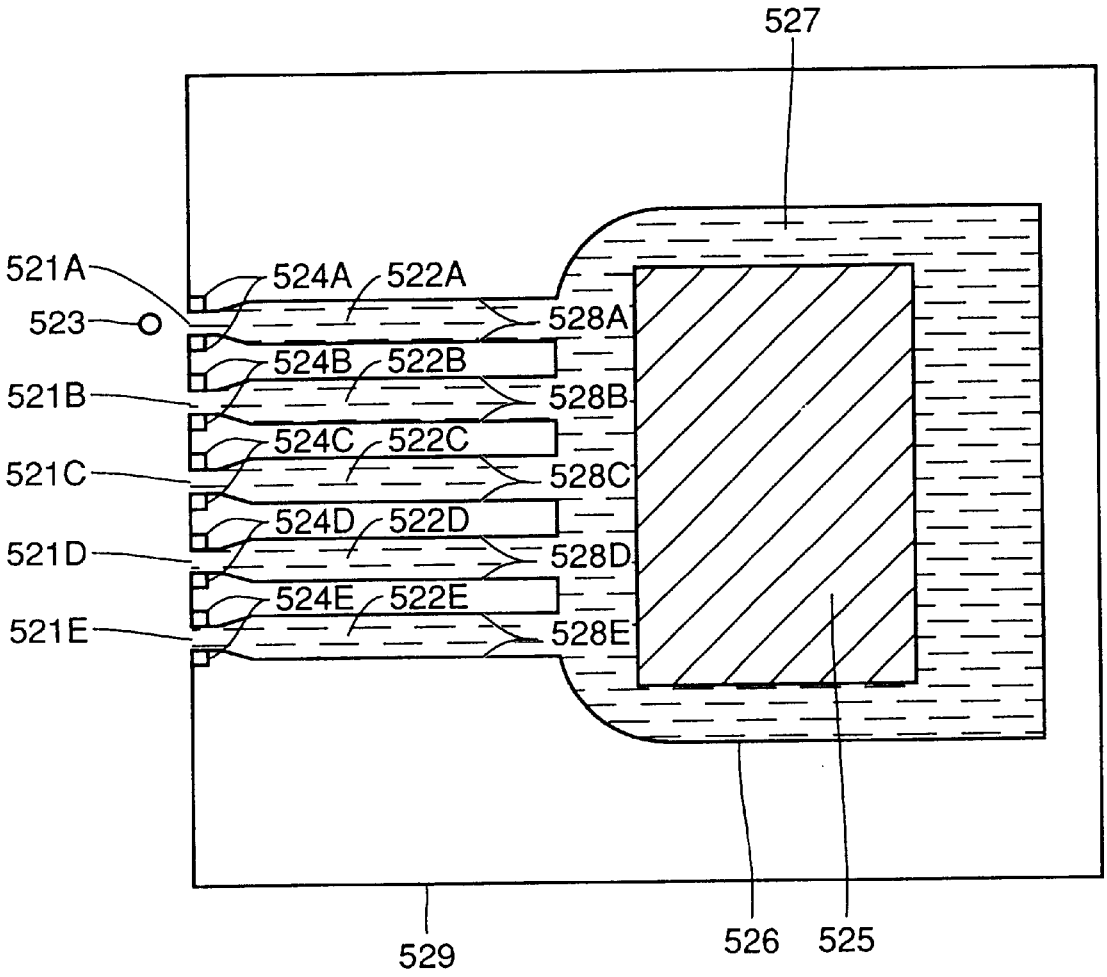
FIG. 1 PRIOR ART
FIG. 1 is a schematic diagram of a conventional ink jet head.
Figure 2:
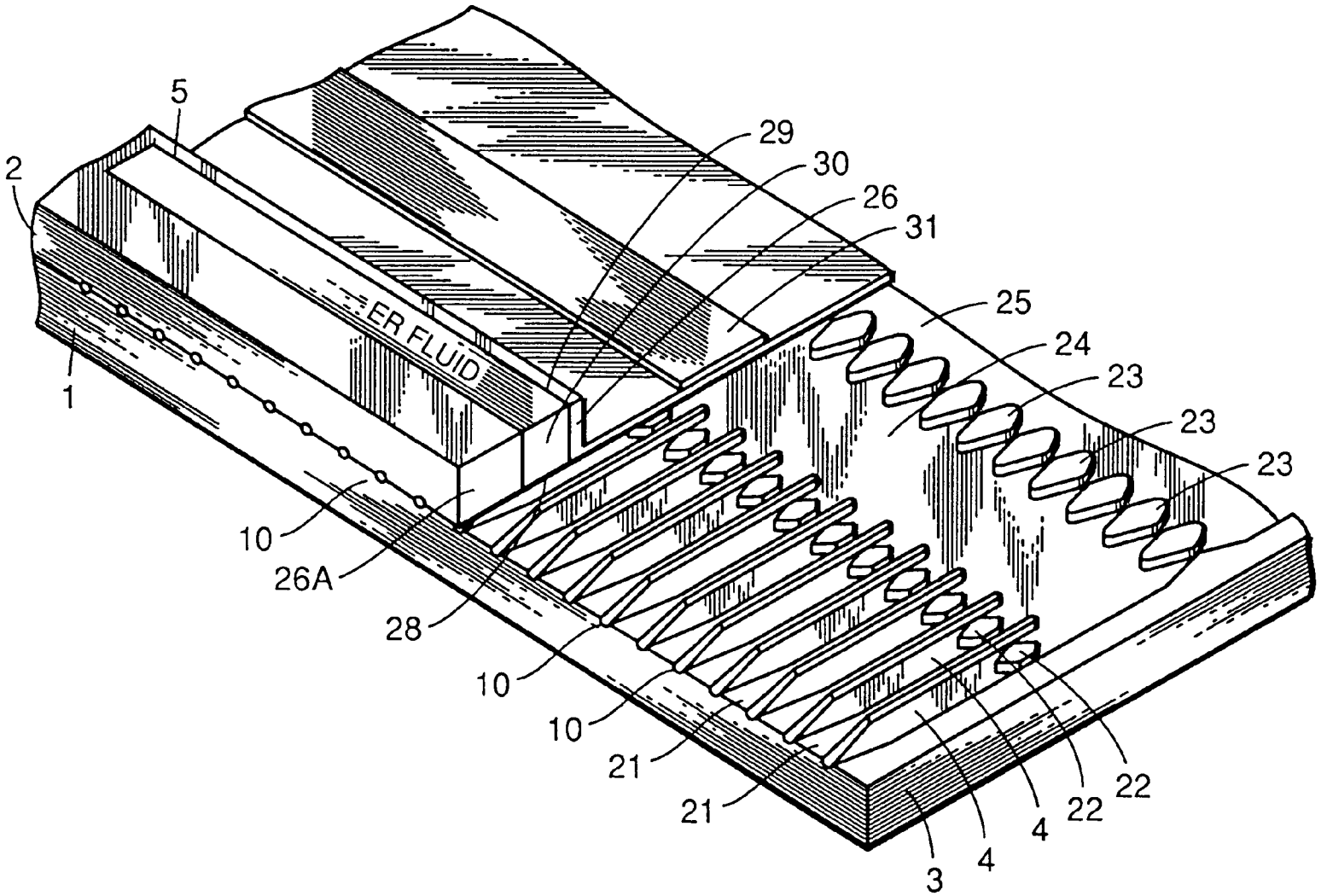
FIG. 2 is a perspective and partially broken view of an ink jet head according to a first embodiment of the present invention.

Referring to FIG. 2, an ink jet head 3 includes a main body 1 and a cover 2 formed of metal or plastic. On the top surface of main body 1 are provided a plurality of orifices 10 opened at one end, and a common ink supply path 25 opened at the other end. Main body 1 includes a plurality of first filter projections 22 provided between orifice 10 and common ink supply path 25 for forming a common ink pressure chamber 24 therebetween, a plurality of second filter projections 23, and a plurality of ink chamber partition walls provided between adjacent first filter projections 22 and having a tapered configuration in the proximity of orifice 10. By the plurality of ink chamber partition walls, a plurality of ink chambers 21 are formed respectively having an orifice 10 of a fan-shaped configuration between adjacent ink chamber partition walls 4.

Cover 2 includes a piezo-electric element 31 fixed above common ink pressure chamber 24 for applying pressure to the ink in common ink pressure chamber 24, an electroviscous fluid chamber 5 provided above ink chamber 21 for accommodating electroviscous fluid 30 therein, an elastic film 28 provided between electroviscous fluid chamber 5 and ink chamber 21 for transmitting pressure therebetween, a film 29 provided above and in contact with electroviscous fluid chamber 5 for relieving the pressure towards the atmosphere, a pair of electrodes 26 and 26A provided at a sidewall of electroviscous fluid chamber 5 for applying a voltage to electroviscous fluid 30, and a control device 6 not shown for applying a voltage to a pair of electrodes 26 and 26A in response to record information to alter the viscosity of electroviscous fluid 30 for controlling ink discharge from orifice 10.

The pair of electrodes 26 and 26A is provided for each ink chamber 21. The passage between adjacent first filter projections 22 at the entrance of ink chamber 21 is formed to have a fluid resistance smaller than that of the passage between adjacent second filter projections 23 at the entrance of common ink pressure chamber 24. Therefore, the pressure wave generated in common ink pressure chamber 24 will not escape towards common ink supply path 25 during its transmission to ink chamber 21 via the filter passage formed between first filter projections 22. Thus, ink discharge is carried out efficiently, and a sufficient supply of ink from common ink supply chamber 25 is provided.

The structure and function of first filter projection 22 at the ink chamber side of common ink pressure chamber 24 will be considered. If there is no first filter projection 22, ink chamber 21 will become a part of common ink pressure chamber 24. This means that the pressure generated by piezo-electric element 31 in common ink pressure chamber 24 varies in ink chamber 21 according to change in the ratio (load condition) of a discharge head to a non-discharge head. More specifically, the pressure in the ink chamber is high since the amount of the absorbed pressure is low due to the few head chambers for the electroviscous fluid to absorb the pressure as will be described afterwards when there is a great number of discharge channels. In contrast, when the number of discharge channels is small, the number of head chambers in which the electroviscous fluid absorbs pressure is high. Therefore, a greater amount of pressure is absorbed, so that the pressure in the ink chamber is lower than that where the number of discharge channels is great. By difference in the load condition, i.e., by variation in the number of discharge heads, the amount and speed of ink discharge from orifice 10 will not be constant. The provision of first filter projections 22 reduces variation in pressure caused by difference in the load condition.

Although FIG. 2 shows a filter formed by the passage between filter projection 22 and ink chamber partition wall 4 for the sake of simplification, a filter with a hole can be used alternatively. According to experimental results, the difference in the generated pressure between the maximum and minimum cases of said load condition was suppressed within a variation of less than 10% when the filter was formed with five holes, each hole having a diameter of 25 microns and a length of 50 microns. When viscosity of electroviscous fluid 30 is increased as a result of voltage applied thereto, ⅓ the pressure of common ink pressure chamber 24 appears in ink chamber 21. When no voltage is applied to electroviscous fluid 30 so that the viscosity thereof becomes lower, only 1/10 the pressure appears.

Next, the relationship between filter 23 at the common ink supply path side of common ink pressure chamber 24 and filter 22 at the side of each ink chamber will be considered. The cross section area of the ink passage of filter 22 between each ink chamber 21 and common ink pressure chamber 24 is greater than the ink passage cross section area of filter 23 between common ink pressure chamber 24 and common ink supply path 25. Accordingly, ink can be discharged efficiently. This is because the pressure wave generated in common ink pressure chamber 24 is apt to be transmitted towards the path having a greater cross section area, i.e. where resistance of fluid is small. More specifically, the pressure wave is easily transmitted towards each ink chamber 21. The filter between the plurality of filter projections 23 may have holes formed therein as in the case of the above-described filter projection 22. The most outward portion of projection filters 22 and 23 forms a filter with the sidewall of main body 1.

Films 28 and 29 are formed of a material that is independent of pressure transmission and that is chemically stable, such as polyphropylene, polyethylene, and polyethylene-terephthalate.

Figure 3A:
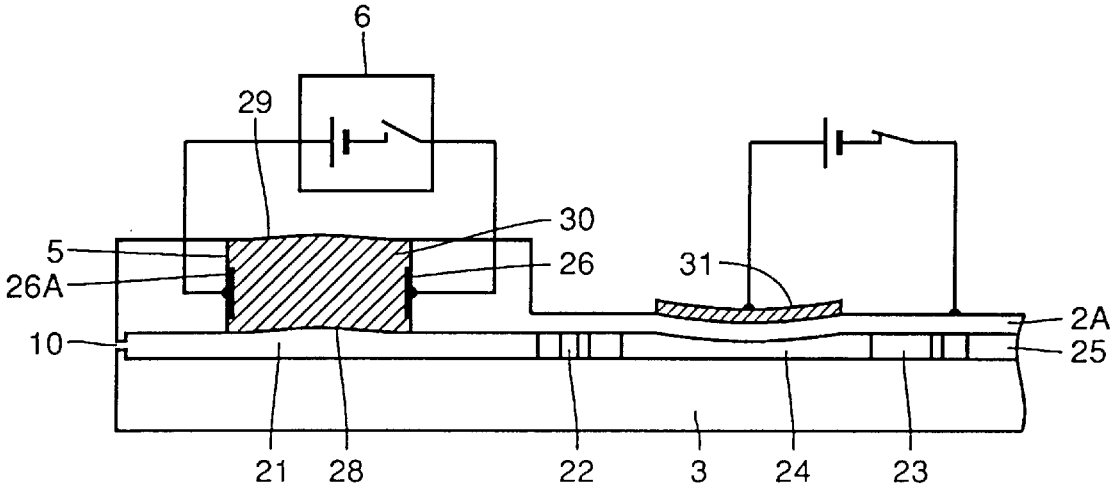
FIGS. 3A and 3B are sectional views of an electroviscous fluid chamber according to the first embodiment of the present invention in a non-operating state and an operating state, respectively.
Figure 3B:
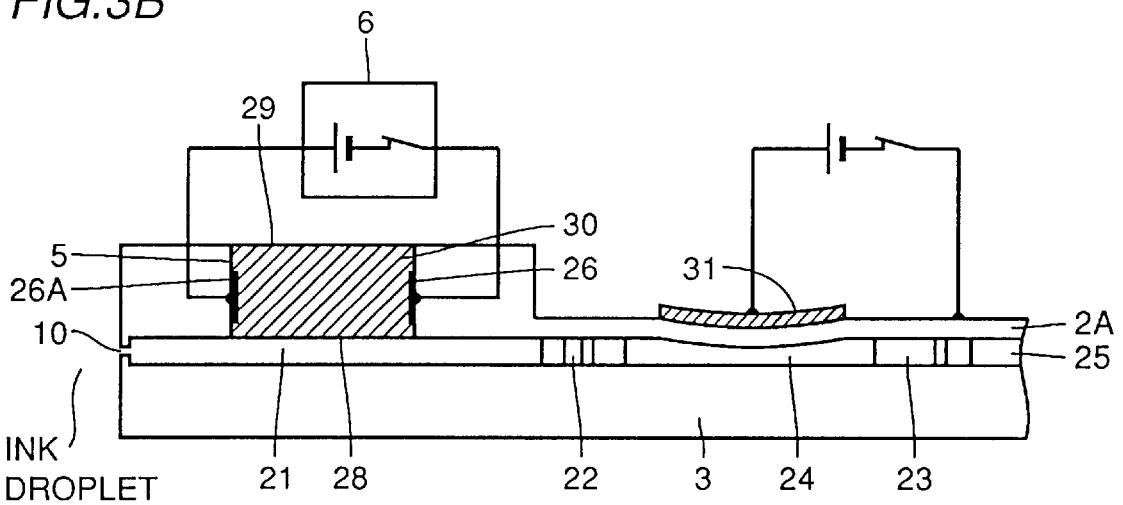

The operating principle of the ink jet head according to the first embodiment will be described hereinafter with reference to FIGS. 3A and 3B. Components in FIGS. 3A and 3B corresponding to those of FIG. 2 have the same reference characters allotted, and their description will not be repeated. In response to application of a voltage to piezo-electric elements 31, piezo-electric element 31 is deflected. According to the bimorph phenomenon with a wall plate 2A of cover 2, the wall is bent inwards. Therefore, the volume in common ink pressure chamber 24 is reduced to result in generation of a pressure wave. When voltage is not applied to electrodes 26 and 26A as shown in FIG. 3A, the viscosity of electroviscous fluid 30 is low. Therefore, even if a pressure wave is generated in common ink pressure chamber 24 by application of a voltage to piezo-electric element 31, the pressure will be absorbed by electroviscous fluid 30 from film 28. The absorbed pressure wave escapes outside via film 29. Therefore, ink is not discharged from orifice 10. When voltage is applied to electrodes 26 and 26A as shown in FIG. 3B, the viscosity of electroviscous fluid 30 becomes higher. Film 28 forms a solid wall by electroviscous fluid 30 with respect to ink. The pressure wave transmitted to ink chamber 21 will reach orifice 10, whereby ink is discharged.

More specifically, electroviscous fluid 30 functions as a wall to reflect the pressure wave when voltage is applied to electroviscous fluid 30. When voltage is not applied, electroviscous fluid 30 does not form a wall and absorbs the pressure wave. Thus, ink discharge is controlled by films 28 and 29 and electroviscous fluid 30.

By applying or not applying voltage to electrodes 26 and 26A for electroviscous fluid 30 in electroviscous fluid chamber 5 adjacent to ink chamber 21, the pressure wave for ink discharge generated by piezo-electric element 31 provided to apply pressure to common ink pressure chamber 24 is reflected or absorbed by electroviscous fluid 30. Therefore, the pressure for discharging ink from orifice 10 is transmitted or cut off to control ink discharge.

Although the piezo-electric element is provided common to all the ink chambers in FIG. 2, the entire ink chamber can be divided into a plurality of groups of ink chambers with a plurality of piezo-electric elements provided corresponding to the plurality of ink chamber groups, as will be described afterwards.

Since the present invention is particularly advantageous in the case where there are many orifices 10, the present invention is described of an embodiment with a plurality of orifices. However, the present invention is also applicable to the case where there is only one orifice.

Modifications of the ink jet head according to the first embodiment will be described hereinafter with reference to FIGS. 4–8. Components in FIGS. 4–8 corresponding to those of FIG. 2 have the same reference characters allotted, and their description will not be repeated.

Figure 4:
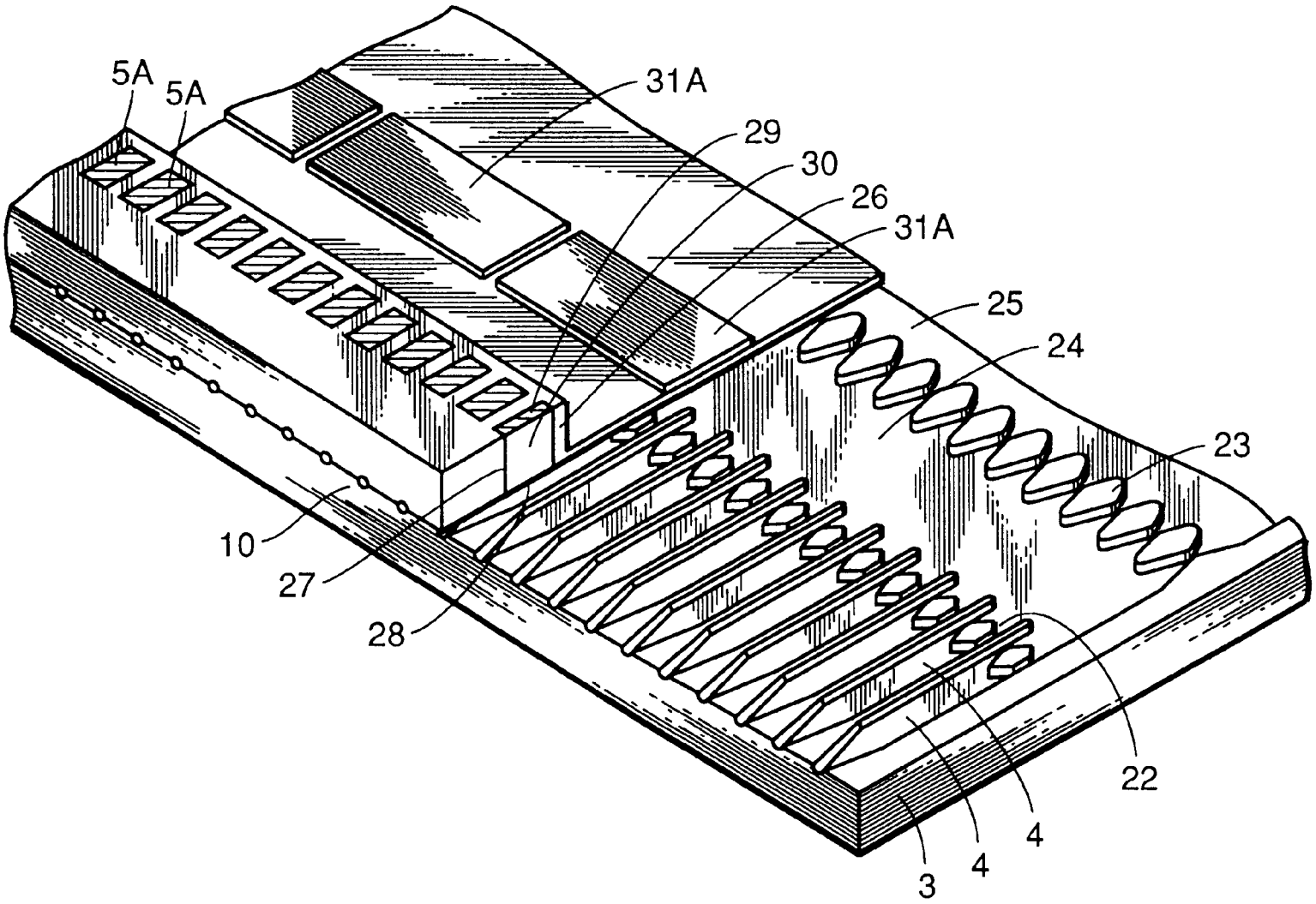
FIGS. 4–8 are perspective and partially broken views of other examples of an ink jet head according to the first embodiment.

The ink jet head of FIG. 4 differs from the ink jet head of FIG. 2 in that the piezo-electric element is divided into a plurality of piezo-electric elements 31A, 31A, . . . , and that the electroviscous fluid chamber is divided into a plurality of electroviscous fluid chambers 5A, 5A, . . . . The plurality of piezo-electric elements 31A are provided corresponding to the groups of the plurality of ink chambers. The plurality of electroviscous fluid chambers 5A are provided corresponding to the plurality of ink chambers 21. The drive circuit can be simplified and the power consumption reduced since the piezo-electric element provided closest to the ink chamber that discharges ink is driven.

Figure 5:
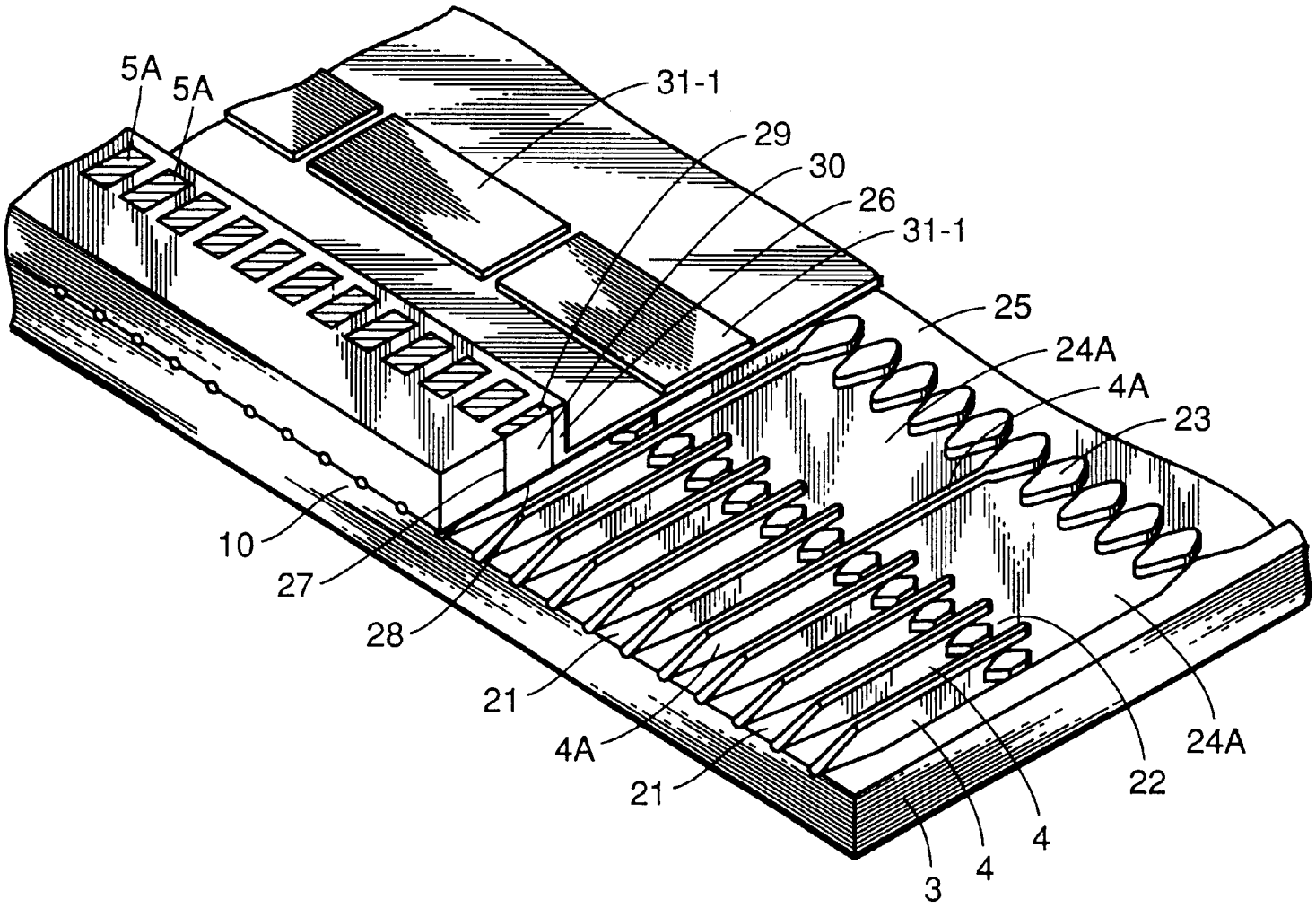

The ink jet head of FIG. 5 differs from the ink jet head of FIG. 4 in that predetermined ones of the plurality of ink chamber partition walls 4 are extended up to second filter projection 23 to divide common ink pressure chamber 24 into a plurality of common ink pressure chambers 24A. Electroviscous fluid chamber 5A is provided corresponding to each of the plurality of ink chambers 21 as in FIG. 4. By dividing the common ink pressure chamber into smaller partitions, the time required for the generated pressure wave to become stable is shortened.

Figure 6:
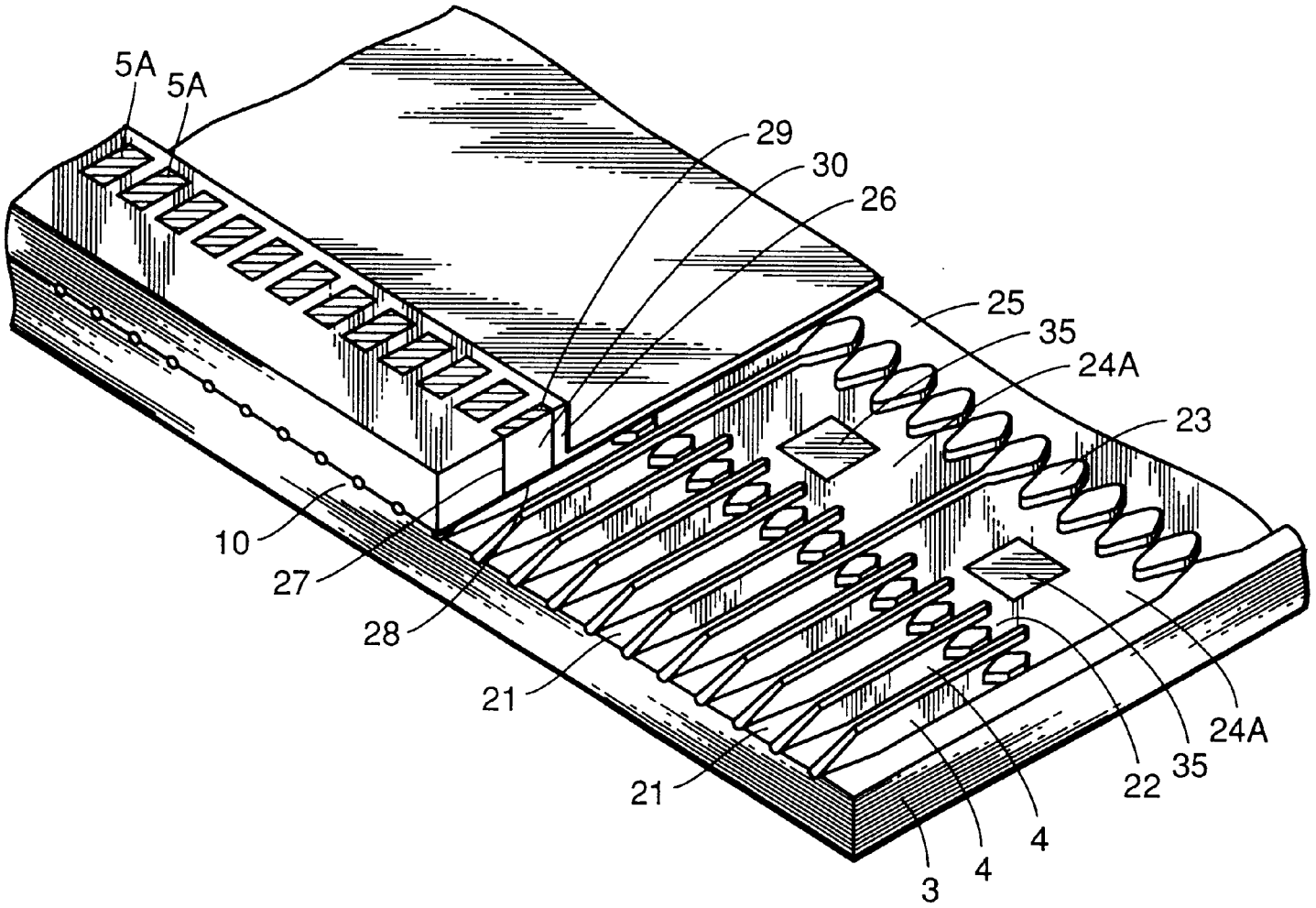

The ink jet of FIG. 6 differs from the ink jet head of FIG. 5 in that an electro thermal exchanger 35 is provided as a pressure generation device instead of a piezo-electric element. A voltage is applied to electro thermal exchanger 35 to generate heat, whereby the ink in common ink pressure chamber 24A is heated. As a result, bubbles are formed to generate pressure.

Figure 7:
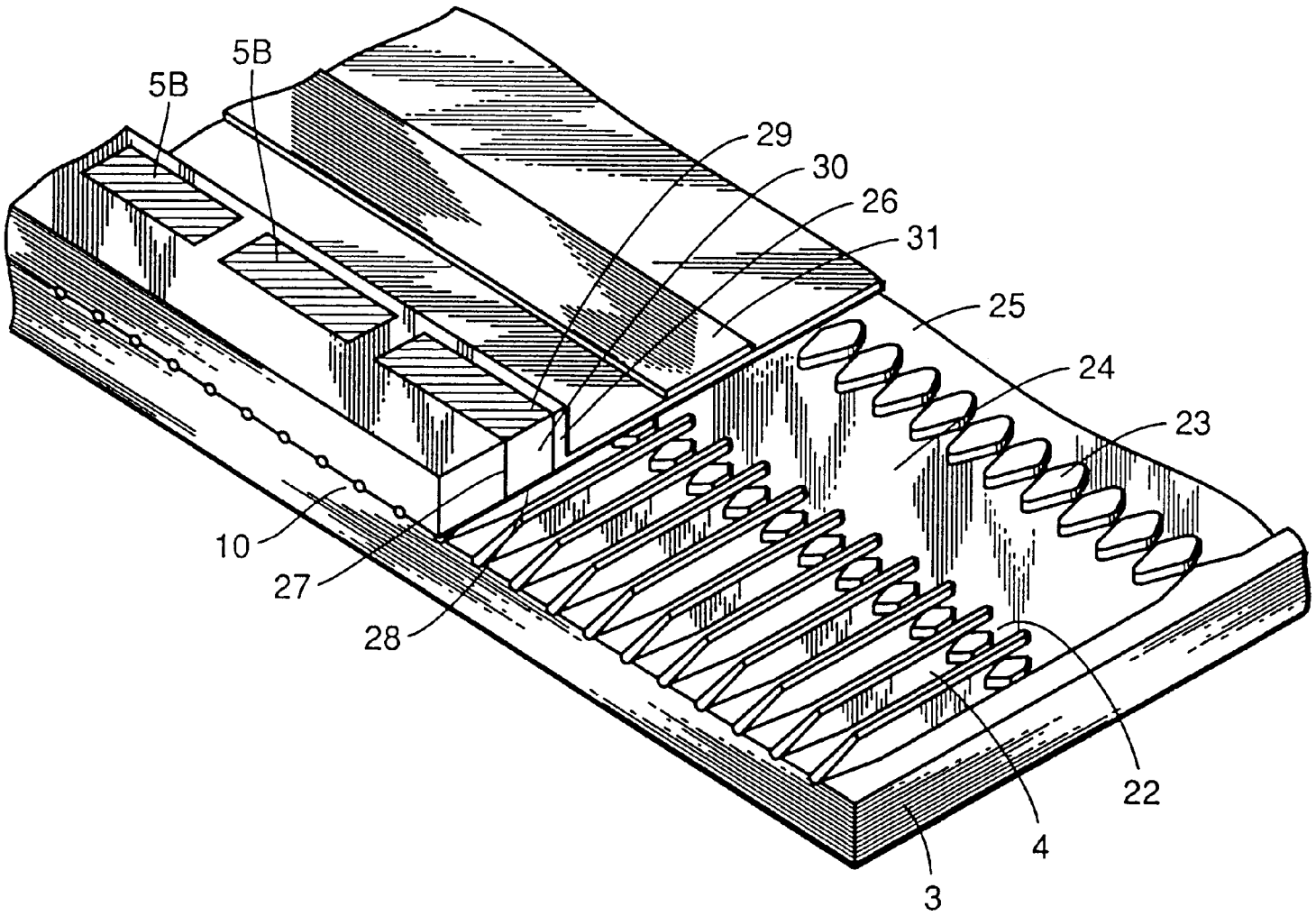

In contrast to FIG. 2 where electroviscous fluid chamber 5 is provided common to the ink chamber, and to FIGS. 4–6 where electroviscous fluid chamber 5A is provided corresponding to each of the plurality of ink chambers 21, the ink jet head of FIG. 7 has an electroviscous fluid chamber 5B provided for each group of ink chambers.

Figure 8:
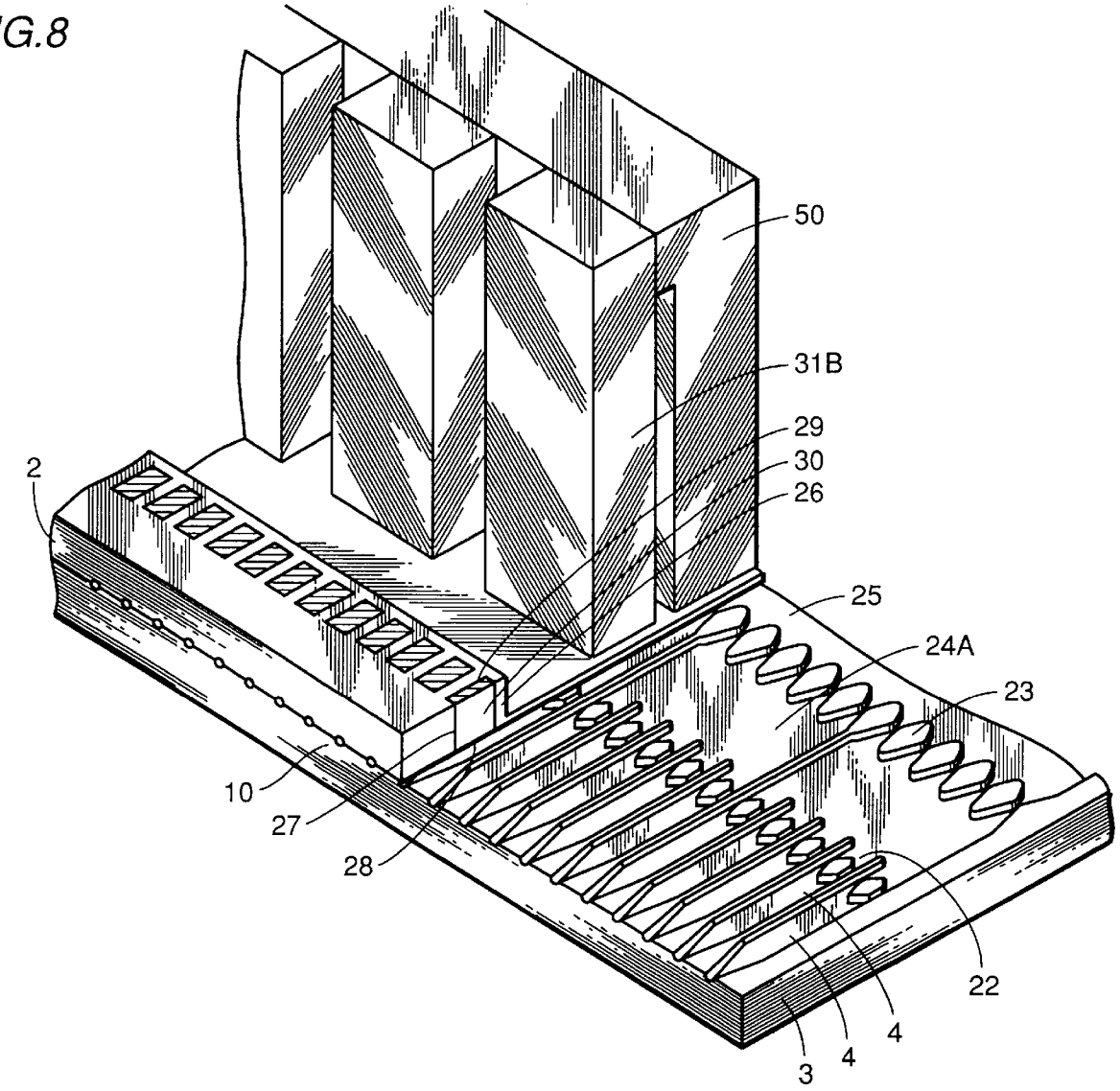

All the aforementioned piezo-electric elements are attached at the top surface of cover 2 to take advantage of a bimorph phenomenon with cover 2. In the ink jet head of FIG. 8, one end of the piezo-electric element is fixed. Pressure is generated taking advantage of the extension/contraction of the other end of the piezo-electric element. Components other than piezo-electric element 31B are similar to those of FIG. 5. Referring to FIG. 8, piezo-electric element 31B has one end fixed to cover 2. An arm 50 having an L-shaped cross section has one end fixed to the other end of piezo-electric element 31B and the other end connected to cover 2. Piezo-electric element 31B extends/contracts in response to application of a voltage thereto. This extension/contraction causes deformation of the wall surface of cover 2, whereby a pressure wave is generated in common ink chamber 24A.

According to the ink jet head of the first embodiment shown in FIGS. 2 and 4–8, electroviscous fluid 30 accommodated in electroviscous fluid chamber 5, 5A or 5B provided at cover 2 is adjacent to the atmosphere via film 29 and adjacent to ink chamber 21 via 28. Electroviscous fluid 30 is sealed within the cavity with films 28 and 29. This provides the advantage that the electroviscous fluid system can be produced and treated independent of other systems. Furthermore, assembly with other systems is facilitated.

Other examples of the pressure absorption portion of the electroviscous fluid chamber according to the first embodiment of the present invention will be described with reference to FIGS. 9–13. Components in FIGS. 9–13 corresponding to those of FIGS. 3A and 3B have the same reference characters allotted, and their description will not be repeated.

Figure 9:
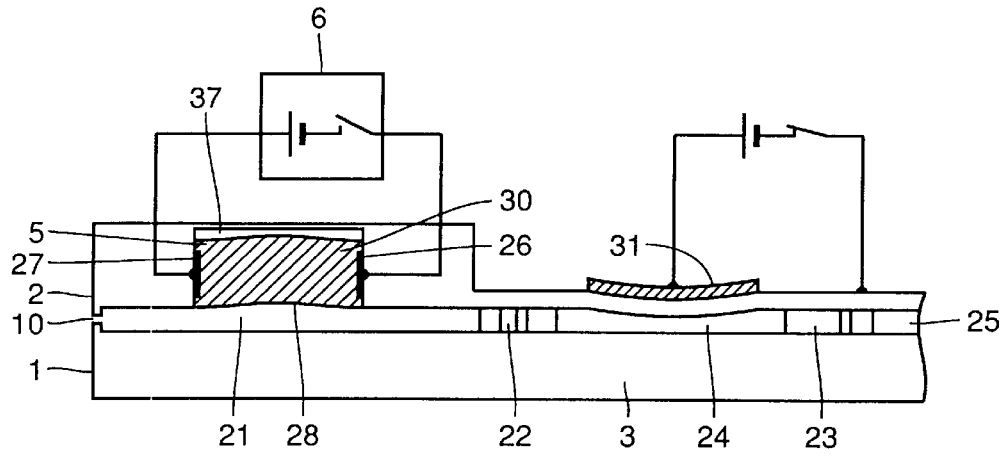
FIGS. 9–13 are sectional and partially broken views of a modification of an electroviscous fluid chamber according to the first embodiment.

FIG. 9 showing a pressure absorption portion corresponds to FIG. 3A. The operation thereof is similar to that of FIG. 3A. The right and left wall surfaces of electroviscous fluid chamber 5 shown in FIGS. 3A and 3B, which are a portion of cover 2, is a rigid body of metal or plastic, whereas the upper end and lower films 28 and 29 are formed of an elastic film such as polypropylene. In FIG. 9, a hard material such as a portion of cover 2, for example, forms a boundary of the atmosphere instead of upper film 29. Also, an air chamber 37 is provided between that wall and the surface of electroviscous fluid 30. The air inside chamber 37 absorbs the pressure wave. All the planes of electroviscous fluid chamber 5 other than the plane of film 28 at the ink side are formed of a rigid body, so that electroviscous fluid chamber 5 forms a sealed chamber. When electroviscous fluid 30 and air is introduced into electroviscous fluid chamber 5, the air in chamber 37 absorbs the pressure wave without having any unexpected pressure applied from the upper portion. Therefore, the effect of absorbing the pressure wave is stable.

Figure 10:
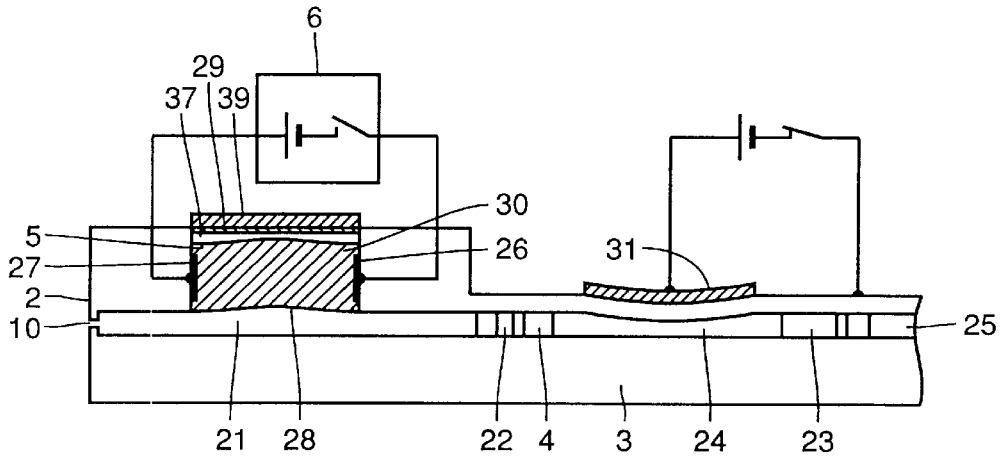

FIG. 10 showing another example of a pressure absorption portion corresponds to FIG. 3A. The operation thereof is similar to that of FIG. 3A. The pressure absorption portion of FIG. 10 differs from that of FIGS. 3A and 3C in that air pressure 37 having the top sealed by film 29 is provided above electroviscous fluid chamber 5, and a rigid body 39 is further provided thereon. The assembly is further facilitated than the case of FIG. 9 since film 29 and rigid body 39 are independently attached to cover 2. It is to be noted that upper film 29 can be omitted.

Figure 11:
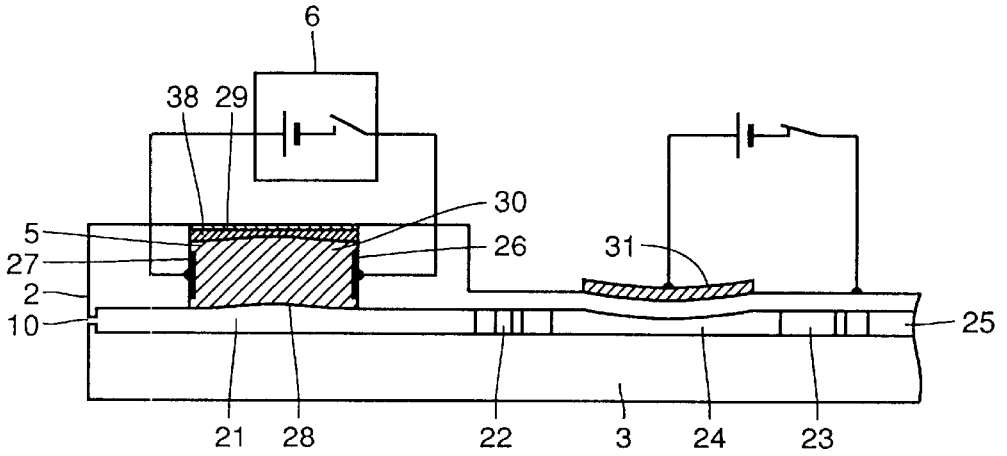

FIG. 11 showing another example of a pressure absorption portion corresponds to FIG. 3A. The operation thereof is similar to that of FIG. 3A. The pressure absorption portion of FIG. 11 differs from the pressure absorption portion of FIGS. 3A and 3B in that the upper wall surface of electroviscous fluid chamber 5 is a portion of cover 2, and that a pressure absorption member 38 such as foam sponge is provided between electroviscous fluid 30 and the wall surface. Pressure absorption member 38 is a substitution for the air in chamber 37 of FIG. 9 or 10. Pressure absorption member 38 absorbs the pressure wave when ink is not discharged.

Figure 12:
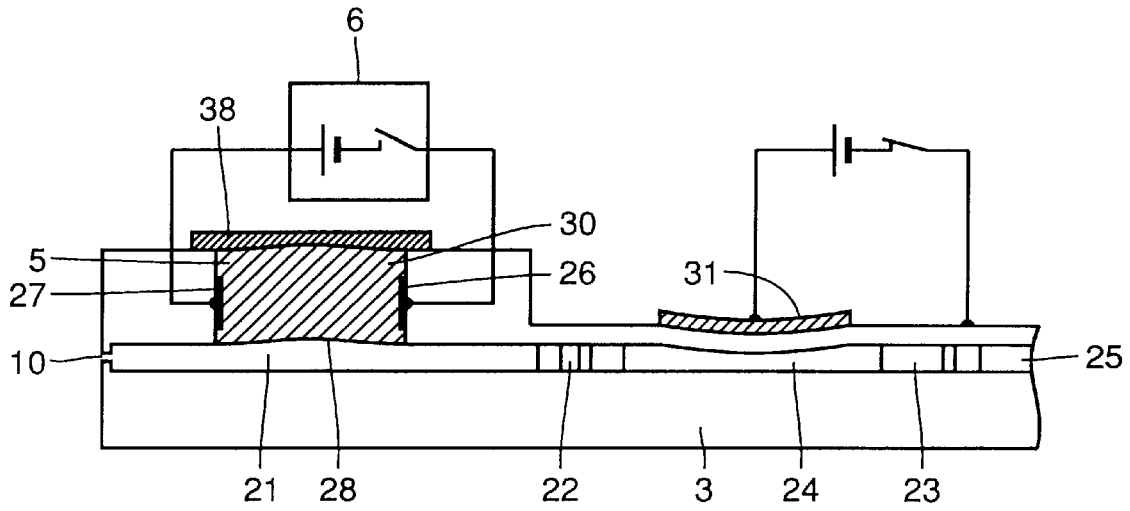

FIG. 12 showing another example of a pressure absorption unit corresponds to FIG. 3A. The operation thereof is similar to that of FIG. 3A. The pressure absorption portion of FIG. 12 differs from the pressure absorption portion of FIG. 3A and 3B in that a pressure absorption member 38 such as foam sponge is provided instead of upper film 29 of electroviscous fluid chamber 5. The level of absorption of the pressure wave can be adjusted by means of pressure absorption member 38 between the atmosphere and electroviscous fluid 30.

Figure 13:
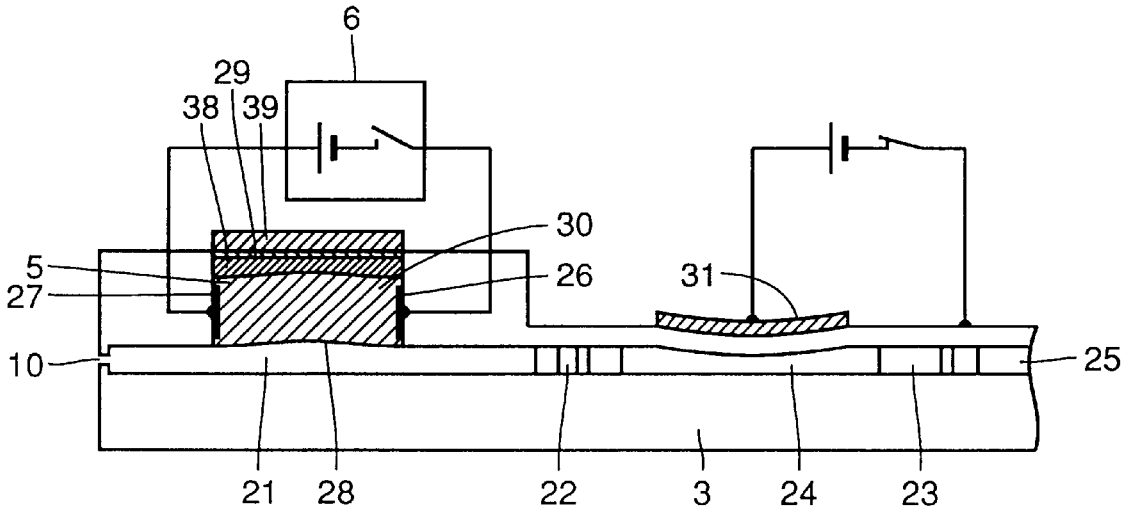

FIG. 13 showing another example of a pressure absorption portion corresponds to FIG. 3A. The operation thereof is also similar to that of FIG. 3A. The pressure absorption portion of FIG. 13 differs from the pressure absorption portion of FIGS. 3A and 3B in that pressure absorption member 38 is provided between film 29 and electroviscous fluid 30, and that the surface of film 29 is covered with rigid body 39, Specifically, pressure absorption member 38 is provided as a substitution of air chamber 37 of FIG. 10. It is to be noted that film 29 can be omitted.

As described above, a pressure generation device is provided adjacent to the ink pressure chamber to generate a pressure wave in ink pressure chamber towards the ink. The control device responds to the record information to control independently the plurality of electrode pairs, whereby the viscosity of the electroviscous fluid is altered. In response, the pressure wave generated at the ink pressure chamber is reflected or absorbed by the electroviscous fluid. Thus, the ink discharge from the orifice of respective ink chambers is controlled.

Ink discharge from an orifice can be controlled by electroviscous fluid completely isolated from the ink. It is therefore not necessary to mix the electroviscous fluid with ink. Thus, a recording liquid of favorable characteristics can be used as the ink without being subjected to characteristical constraints as the electroviscous fluid.

As a result, printing can be carried out at a favorable quality. The head will not consume the electroviscous fluid per se. Therefore, the running cost is lower than the case where recording liquid which is a mixture of ink and electroviscous fluid is used. Furthermore, the problems such as clogging, precipitation, and attachment of a colorant encountered in the case where a recording liquid of a mixture of ink and electroviscous fluid is used.

Ink discharge from the orifice of respective ink chambers can be controlled by the pressure generation device provided common to the plurality of ink chambers. Therefore, the head can be reduced in size without degrading printout of favorable quality.

The pressure absorption portion of the electroviscous fluid chamber can absorb the pressure wave generated in the ink chamber and absorbed by the electroviscous fluid. Since the pressure wave corresponding to an ink chamber that does not discharge ink is absorbed by the pressure Aabsorption portion, ink can be discharged at uniform pressure independent of the number of non-discharge heads.

Second Embodiment

In the first embodiment shown in FIGS. 2–13, the pressure of each ink chamber communicating with the common ink pressure chamber to which pressure is applied to ink therein is reflected or absorbed by adjusting the viscosity of the electroviscous fluid in the adjacent electroviscous fluid chamber to control ink discharge. In the second embodiment, ink discharge is controlled by applying pressure to the electroviscous fluid, not to the ink in the common ink pressure chamber.

Figure 14:
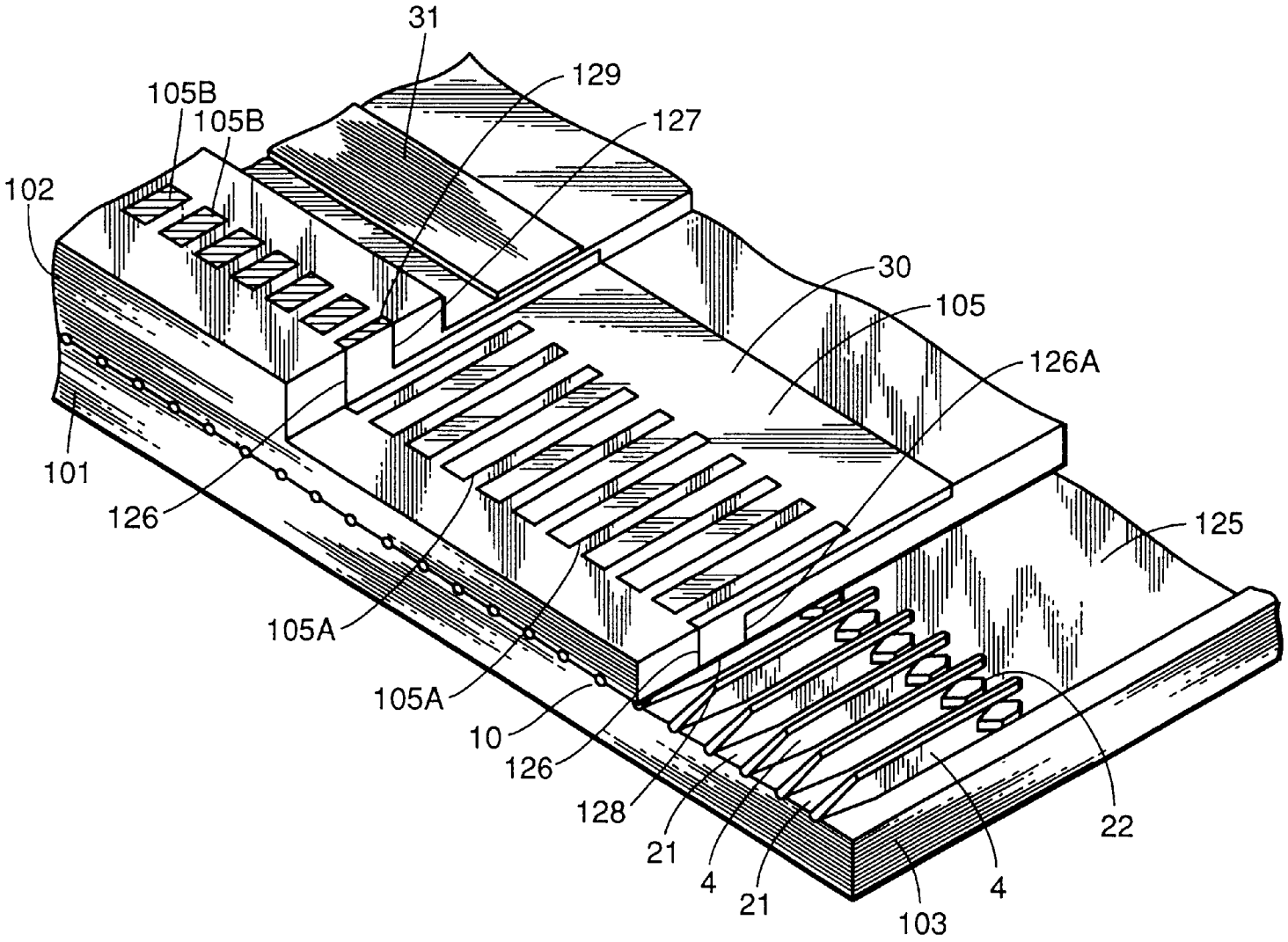
FIG. 14 is a perspective and partially broken view of an ink jet head according to a second embodiment of the present invention.

The components in FIG. 14 corresponding to those of FIG. 2 have the same reference characters allotted, and their description will not be repeated. Main body 101 of ink jet head 103 of the second embodiment differs from ink jet head of FIG. 2 in that a common ink pressure chamber is not provided, and that a common ink supply path 125 directly communicates with each ink chamber 21. Cover 102 greatly differs from the cover of FIG. 2. A common piezo-electric element 31 is provided at the surface of cover 102. An electroviscous fluid chamber 105 is provided beneath piezoelectric element 31 over substantially the whole width of ink jet head 103. A major portion of the wall of electroviscous fluid chamber 105 is formed of the inner wall of cover 102. Electroviscous fluid chamber 105A branched in a comb-like manner is provided above and along ink chamber 21. The leading edge of the diverged electroviscous fluid chamber 105A forms an electroviscous fluid chamber 105B, and is in contact with ink chamber 21 via a film 28 that serves to transmit pressure to ink. Also, a film 129 is provided in electroviscous fluid chamber 105B to absorb the pressure by emitting the pressure to the atmosphere.

Figure 15:
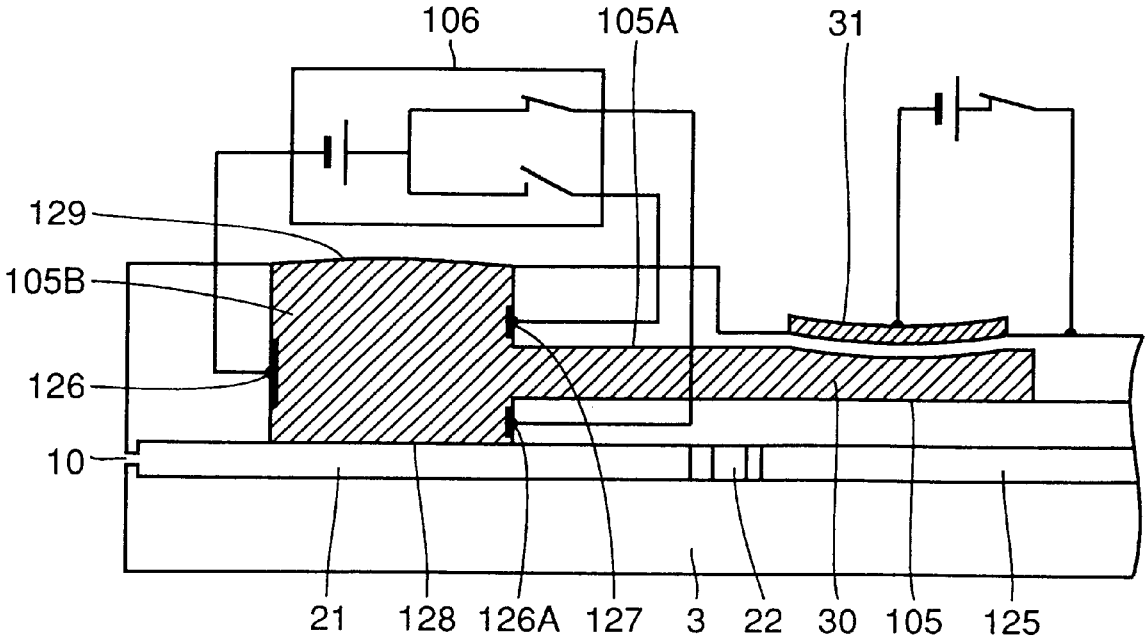
FIG. 15 is a sectional view of an electroviscous fluid chamber according to the second embodiment.

When a voltage is applied by control device 106 not shown to an electrode 126 provided at the wall of electroviscous fluid chamber 105B and electrodes 126A and 127 facing electrode 126 (function of these electrodes will be described afterwards with reference to FIG. 15), the viscosity of the electroviscous fluid inside electroviscous fluid chamber 105B corresponding to each ink chamber is altered. The conduit of the filter formed between filter projection 22 provided between each ink chamber 21 and common ink supply path 125, and ink chamber partition wall 4 is small, so that the fluid resistance is great. Therefore, the pressure wave generated in ink chamber 21 will not escape towards common ink supply path 125, and ink can be sufficiently supplied to each ink chamber 21 from common ink supply path 125. Film 128 is formed of a material that is unsusceptible to transmission of pressure wave and that is chemically stable.

According to the above-described structure, the pressure wave generated in electroviscous fluid chamber 105 by piezo electric element 31 is transmitted to each electroviscous fluid chamber 105B. When voltage is applied to electrode 126 and opposite electrode 127 of electroviscous fluid chamber 105B as will be described afterwards, the viscosity of that portion of the electroviscous fluid increases. Thus, pressure is transmitted to the ink in the corresponding ink chamber 21, whereby ink is discharged from orifice 10. The pressure of an electroviscous fluid chamber that does not have a voltage applied to electrodes 126 and 127 escapes to the atmosphere via upper film 129. Therefore, ink is not discharged. The structure of main body 1 is simplified whereas the structure of cover 2 becomes slightly complicated. Electroviscous fluid chamber 105 can be provided corresponding to each ink chamber 21, as will be described afterwards.

The operation principle of the ink jet head according to the second embodiment will be described with reference to FIG. 15. FIG. 15 corresponds to FIG. 3A. Components corresponding to those of FIG. 3A have the same reference characters allotted, and their description will not be repeated.

During a print out operation of the ink jet head, pressure is generated by piezo-electric element 31 in electroviscous fluid chamber 105 by a driving frequency. The pressure wave is transmitted via electroviscous fluid 30. Electrodes 126 and 126A, and electrodes 126 and 127 apply an electric field to electroviscous fluid 30 to control the viscosity. Therefore, ink is discharged when the pressure wave is transmitted to ink chamber 21. Ink is not discharged when the pressure wave is not transmitted to ink chamber 21, and escapes to the atmosphere.

When current is applied across electrodes 126 and 126A, and not across electrodes 126 and 127, the viscosity of the portion of electroviscous fluid 30 in electroviscous fluid chamber 105B adjacent to ink chamber 21 becomes higher, whereby the pressure wave is cut off from ink chamber 21. Since the viscosity of the portion of electroviscous fluid 30 adjacent to the atmosphere via film 129 is still low, the pressure wave escapes to the atmosphere via film 129.

When current is not applied across electrodes 126 and 126A, and applied across electrodes 126 and 127, the viscosity of the portion of electroviscous fluid 30 near film 129 increases, whereby the pressure wave is out off from the atmosphere. Since the viscosity of electroviscous fluid 30 in the proximity of film 128 that communicates with ink chamber 21 is still low, the pressure wave is transmitted to ink chamber 21, whereby ink is discharged.

More specifically, by applying current to either pair of electrodes 126 and 126A or 126 and 127, the transmitted pressure wave generated in electroviscous fluid chamber 105 is either transmitted to ink chamber 21 or emitted to the atmosphere for control of ink discharge.

In response to change in the number of discharge channels, the ratio of the number of ink chambers to which pressure is transmitted to the number of ink chambers to which pressure is cut off is altered to result in variation in the pressure remaining in the electroviscous fluid chamber. Therefore, variation in the load state of the electroviscous fluid chamber according to change in the residual pressure is prevented. When current is applied across electrodes 126 and 126A to cut off the pressure towards ink chamber 21 so that pressure remains, no current is applied across electrodes 126 and 27, so that pressure escapes via film 129. Therefore, the load state of the electroviscous fluid chamber is the same comparable to the case where the pressure is cut off between electrodes 126 and 127 so that pressure is transmitted to ink chamber 21 as a result of inhibiting current application across electrodes 126 and 126A and allowing current application across electrodes 126 and 127.

In practice, the motion of film 129 is facilitated than film 128 that moves while transmitting a pressure wave to the ink in ink chamber 21 since film 129 is exposed to the atmosphere. By selecting the structure as set forth in the following, the motion of film 129 is constrained so that the load is equal.

(1) The area of film 129 is set smaller than that of film 128.

(2) The thickness of film 129 is set greater than that of film 128.

(3) The ratio of area to film periphery (constrained portion) is set smaller when the area and film thickness of films 128 and 129 are the same.

Transmittance of the pressure wave from electroviscous fluid chamber 105B to ink chamber 21 is facilitated by narrowing the conduit of electroviscous fluid 105A diverged from electroviscous fluid chamber 105 to electroviscous fluid chamber 105B to increase the fluid resistance.

Modifications of the ink jet head of the second embodiment will be described hereinafter with reference to FIGS. 16–19. Components in FIGS. 16–19 corresponding to those of FIG. 14 have the same reference characters allotted, and their description will not be repeated.

Figure 16:
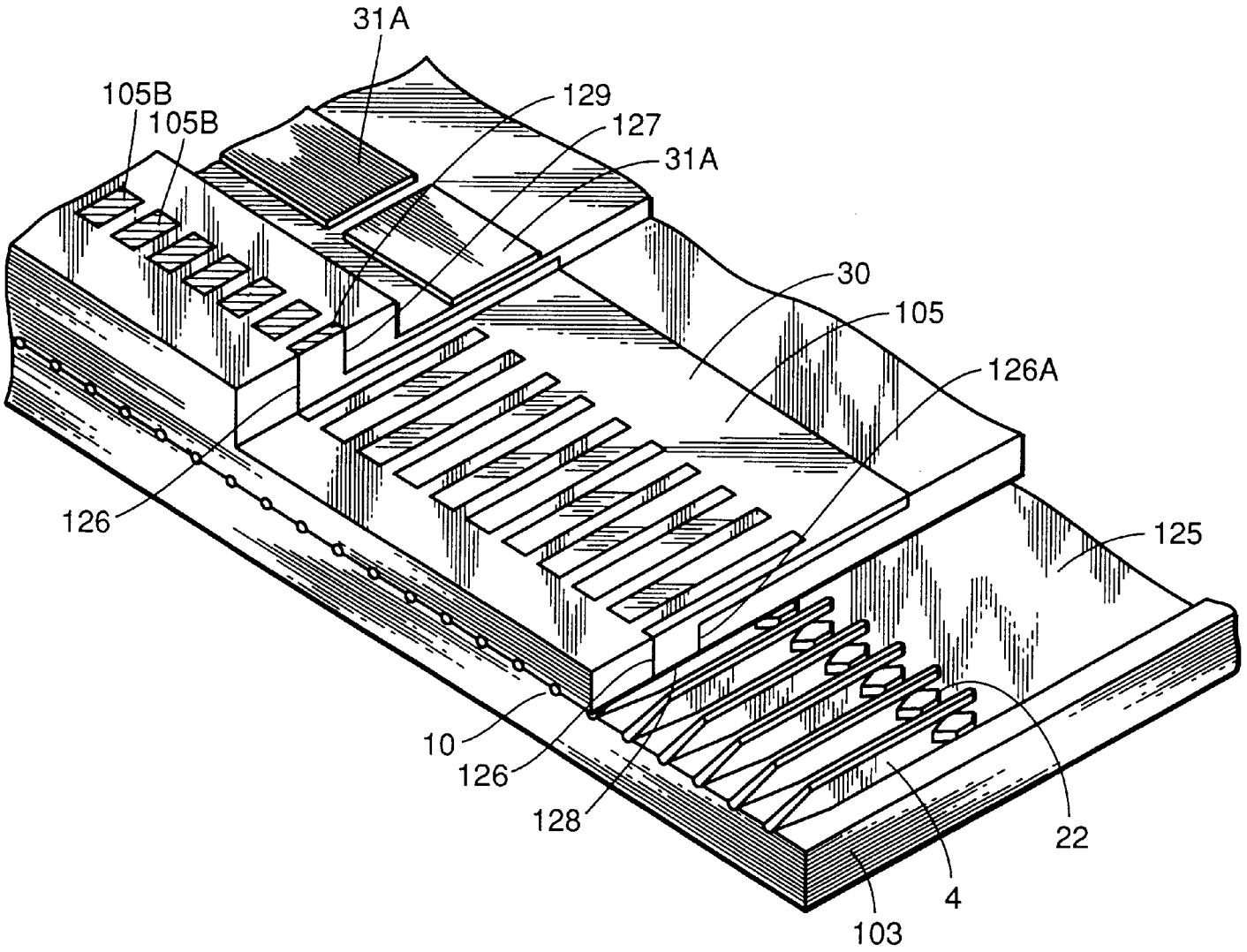
FIGS. 16–19 are perspective and partially broken views of a modification of an ink jet head according to the second embodiment.

The ink jet head shown in FIG. 16 differs from the ink jet head of FIG. 14 in that piezo-electric element 31A is divided into a plurality of portions corresponding to the plurality of ink chambers.

Figure 17:
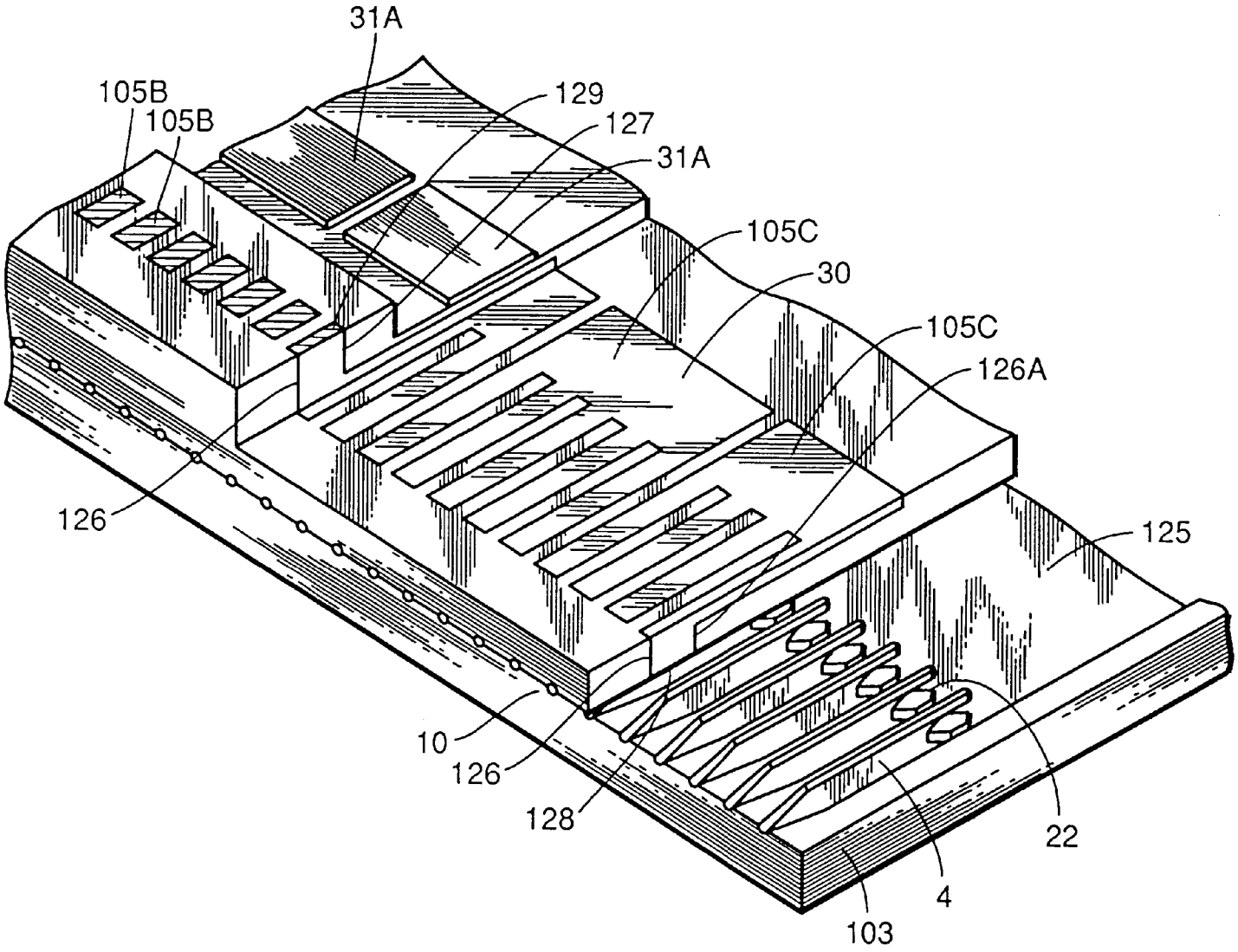

The ink jet head of FIG. 17 differs from the ink jet head of FIG. 16 in that an electroviscous fluid chamber 105C divided into a plurality of portions is provided corresponding to the plurality of portions of piezo electric element 31A. As described with reference to FIGS. 4 and 5, the drive circuit is simplified.

Figure 18:
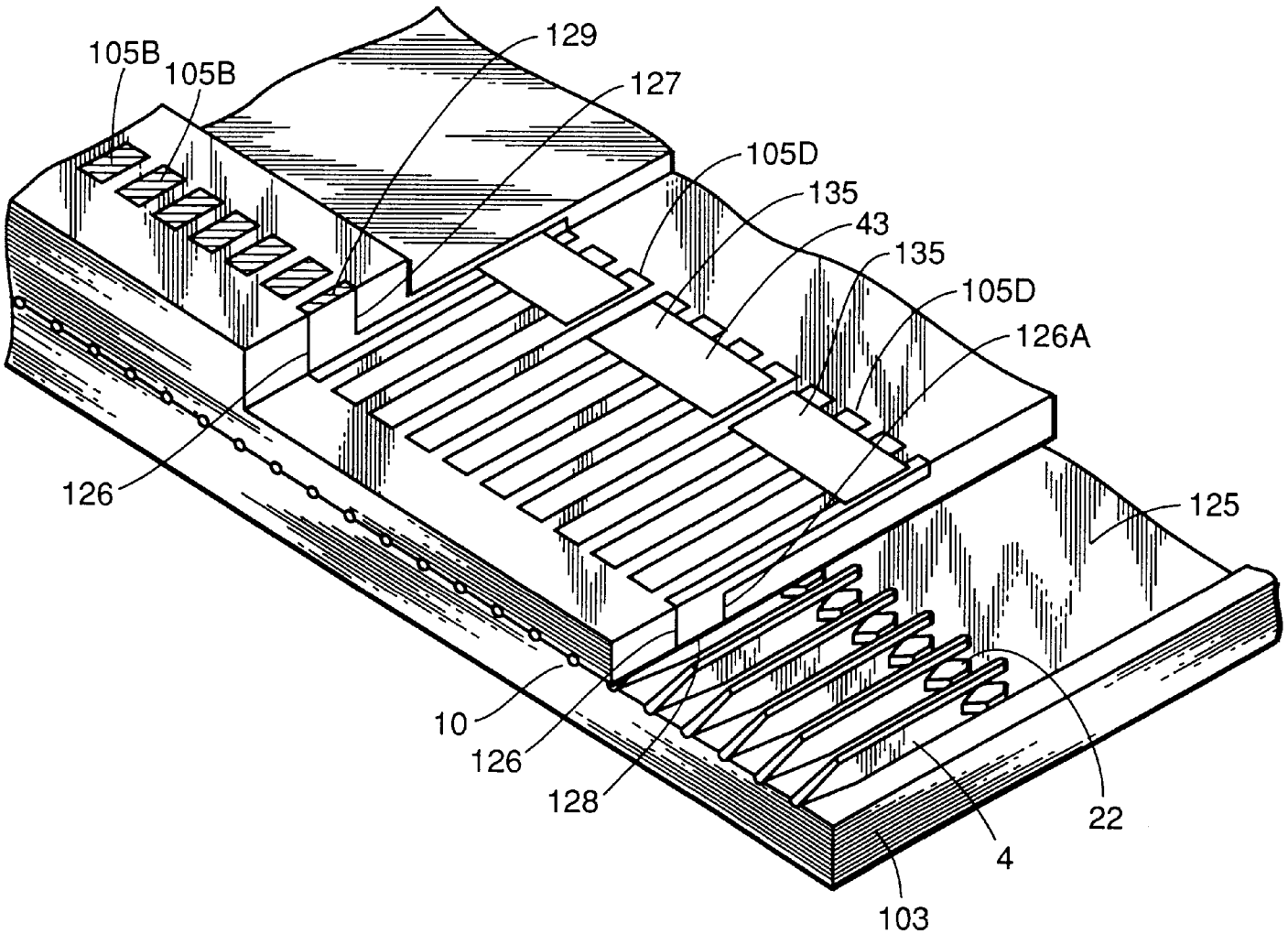

The ink jet head of FIG. 18 corresponds to FIG. 4, for example, and differs from the ink jet head of FIG. 17 in that an electroviscous fluid chamber 105D is provided corresponding to each ink chamber, and that an electro thermal exchanger 135 is provided corresponding to each of the plurality of electroviscous fluid chambers 105D, instead of piezo electric element 31A as the pressure wave source. The drive energy can be reduced to improve the efficiency of ink discharge.

Figure 19:
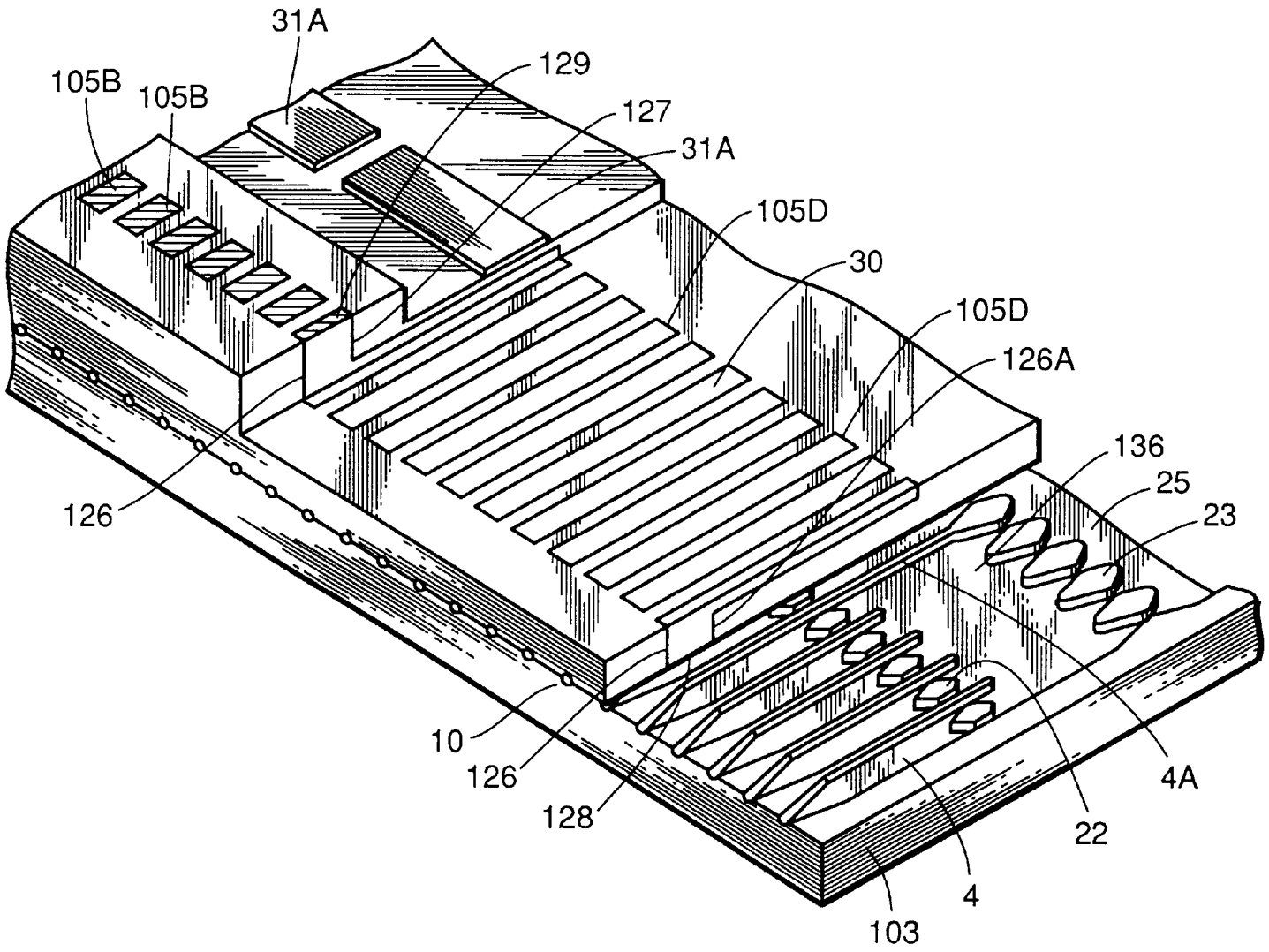

The ink jet head of FIG. 19 differs from the ink jet head of FIG. 18 in that a piezo electric element 31A serving as a pressure generation source is provided corresponding to each of the plurality of electroviscous fluid chambers 105D. In contrary to FIGS. 14, 16, 17 and 18, the ink jet head of FIG. 19 has a common ink chamber 136 provided between filter projections 22 and 23. Common ink chamber 136 is separated from the adjacent common ink chamber by an ink chamber partition wall 4A. The structure thereof is similar to that of FIG. 5. In this case, a common electroviscous fluid chamber 105C can be provided with respect to the plurality of electroviscous fluid chambers 105B as shown in FIG. 17, instead of providing electroviscous fluid chamber 105D individually.

Other examples of an electroviscous fluid chamber according to the second embodiment will be described hereinafter with reference to FIGS. 20–23. The components of FIGS. 20–23 corresponding to those of FIG. 15 have the same reference characters allotted, and their description will not be repeated. The electroviscous fluid chamber of FIG. 20 corresponds to that of FIG. 9 where an air chamber is provided to apply pressure to ink. The upper portion of electroviscous fluid chamber 105B is the inner wall of cover 102. Air chamber 137 is provided above electroviscous fluid 30. In contrast to the case of FIGS. 14 and 15 where the upper portion of electroviscous fluid chamber 105B is sealed by film 129 to absorb the pressure by emitting it, the ink jet head of FIG. 20 has the pressure wave absorbed by the air in chamber 137 of electroviscous fluid chamber 105B.

Figure 20:
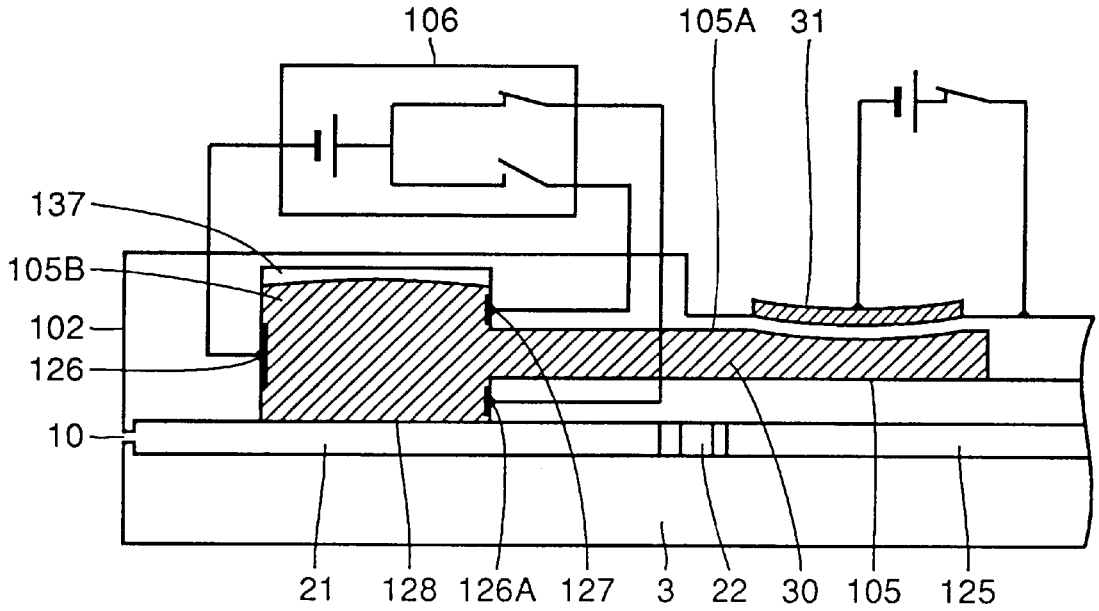
FIGS. 20–23 are sectional views of a modification of an electroviscous fluid chamber according to the second embodiment.
Figure 21:
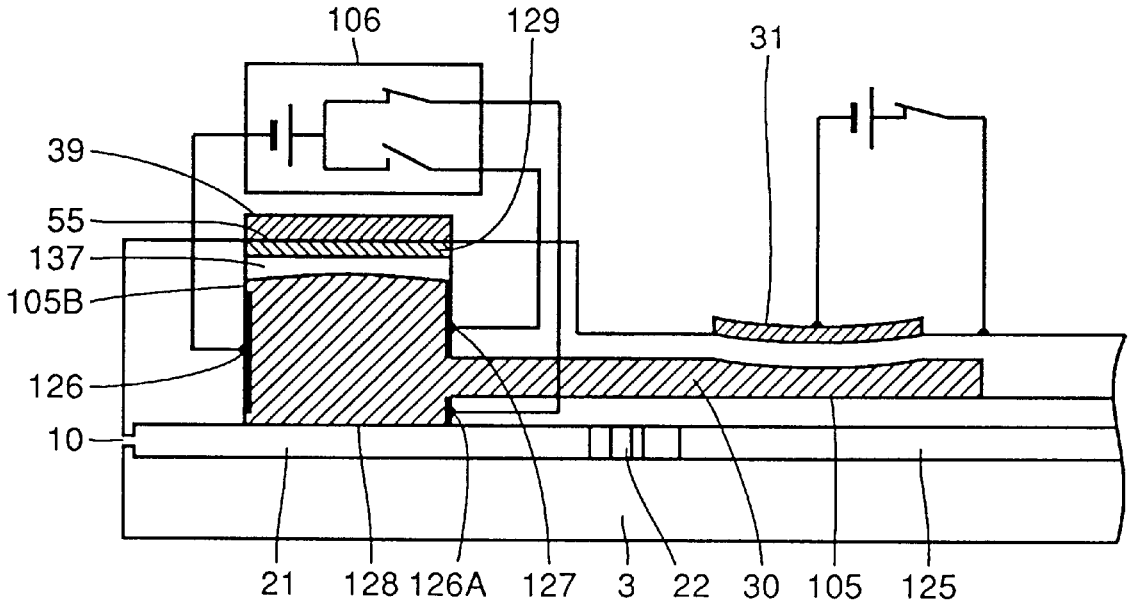

The ink jet head of FIG. 21 corresponds to that of FIG. 10 where pressure is applied to the ink in the common ink pressure chamber. The atmosphere side of electroviscous fluid chamber 105B is covered with rigid body 39. Air chamber 137 is provided thereunder with film 129 therebetween. The operation is similar to FIG. 20, provided that the pressure wave is absorbed by the air in chamber 137 when ink is not to be discharged. Film 129 can be omitted by selecting an appropriate material of rigid body 39.

Figure 22:
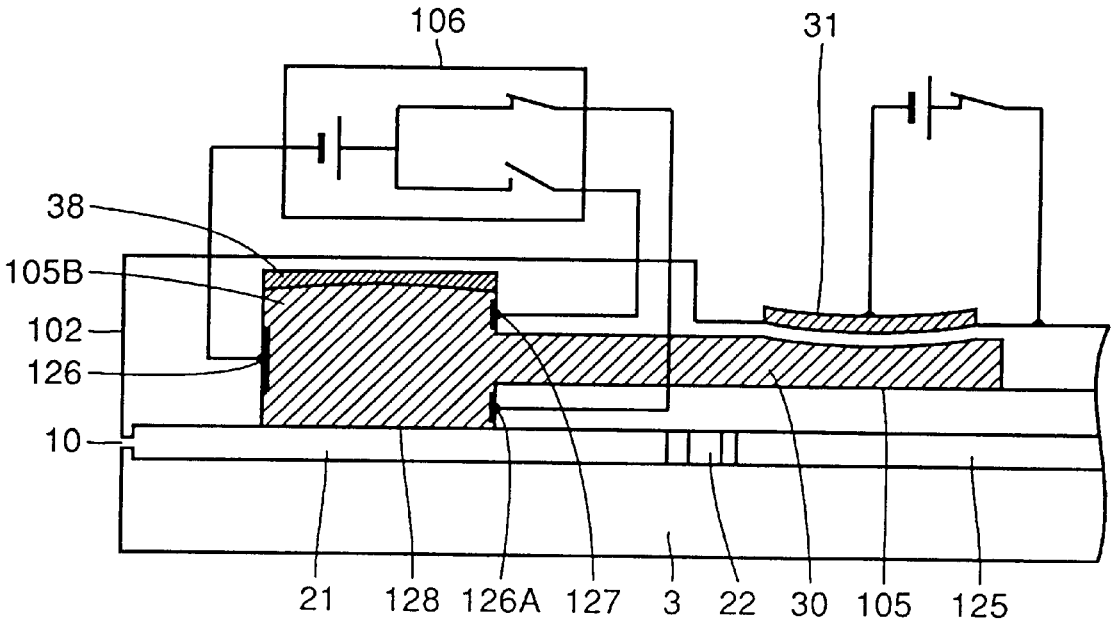

The ink jet head of FIG. 22 corresponds to that of FIG. 11. The upper portion of electroviscous fluid chamber 105B is sealed by the wall surface of cover 102 instead of the film, and a pressure absorption member 38 is provided between electroviscous fluid 30 and the wall of cover 102. Pressure absorption member 38 absorbs the pressure wave when ink is not discharged. The operation thereof is similar to that of FIG. 20.

Figure 23:
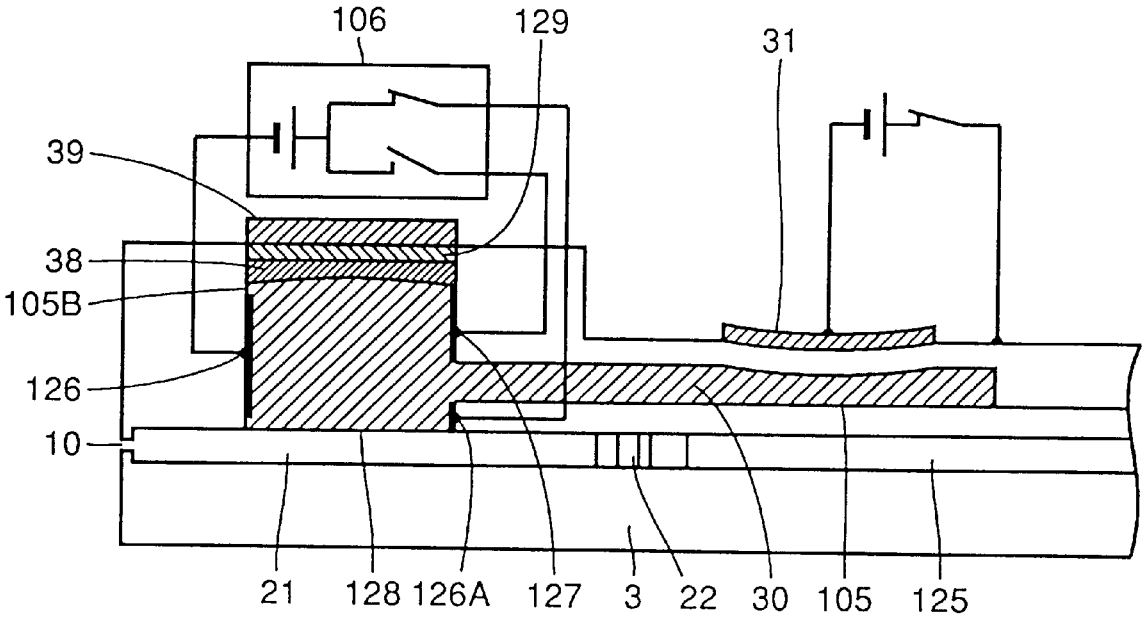

The ink jet head of FIG. 23 corresponds to that of FIG. 13, and differs from the ink jet head of FIG. 22 in that film 129 and pressure absorption member 38 are provided between the liquid surface of electroviscous fluid 30 and a rigid body 39 substituting the upper wall surface of electroviscous fluid chamber 105B. It is to be noted that film 129 can be omitted. The operation is similar to that of FIG. 20.

As described above, the pressure generation device is provided adjacent to the electroviscous fluid chamber to generate a pressure wave to the electroviscous fluid chamber within the electroviscous fluid chamber. The control device responds to the record information to alter the viscosity of the electroviscous fluid by controlling independently the plurality of pair of electrodes. The pressure wave generated at the electroviscous fluid chamber is transmitted or cut off by the electroviscous fluid. As a result, the ink discharge from the orifice of the plurality of ink chambers is controlled.

By virtue of the electroviscous fluid completely isolated from the ink, ink discharge from the orifice can be controlled. More specifically, it is not necessary to mix the electroviscous fluid with the ink. A recording liquid of favorable characteristics can be used for the ink per se without being subjected to the characteristical constraints as the electroviscous fluid.

Therefore, print out can be carried out at a favorable quality. Furthermore, the head does not consume the electroviscous fluid itself. The head has a lower running cost comparable to the case where a recording liquid of a mixture of ink and electroviscous fluid is used. Furthermore, the problem of clogging, precipitation and adhesion of a colorant encountered in the case where recording liquid of a mixture of ink and electroviscous fluid is used can be circumvented.

The ink discharge from the orifice of a plurality of ink chambers can be controlled by the pressure generation device provided common to the plurality of ink chambers. Therefore, the head can be reduced in size carrying out without degrading the print out quality.

The pressure absorption portion of the electroviscous fluid chamber can absorb the pressure wave generated at the electroviscous fluid chamber, that is absorbed by the electroviscous fluid. Since the pressure wave corresponding to an ink chamber that does not discharge ink can be absorbed by the pressure absorption unit, ink can be discharged at a uniform pressure independent of the number of non-discharge heads.

Third Embodiment

In the third embodiment, ink discharge is controlled by applying pressure to the electroviscous fluid.

Figure 24:
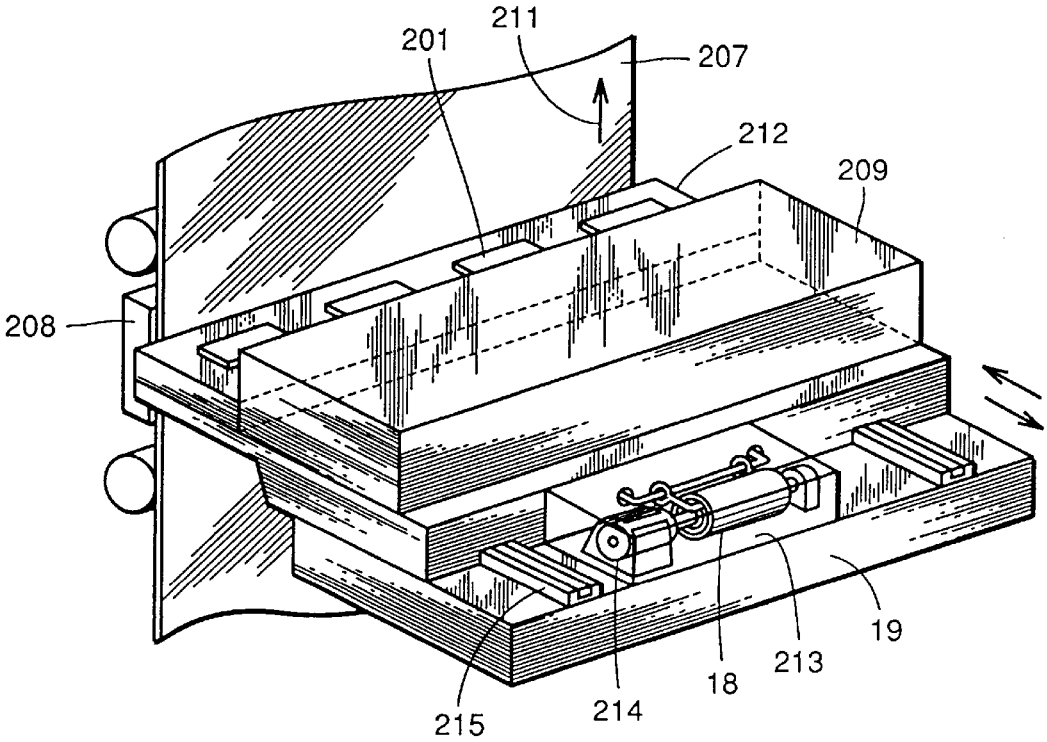
FIG. 24 is a schematic diagram of an ink jet head according to a third embodiment of the present invention.

Referring to FIG. 24, an ink jet head 200 of the third embodiment includes a recording head 212 disposed perpendicular to the forward direction 212 of a record medium 207, and fixed in the lateral direction, a motor 214 controlling the distance between the surface of record medium 207 and the orifice of the head in consistency with the print out timing, a cam mechanism 213, and an electrode 208 provided at the back side of record medium 7 for generating an electric field. Recording head 212 includes a piezo-electric element 201 which is a discharge pressure source common to the plurality of channels, and an IC 217 for application to the pair of control electrodes of each channel.

Figure 25:
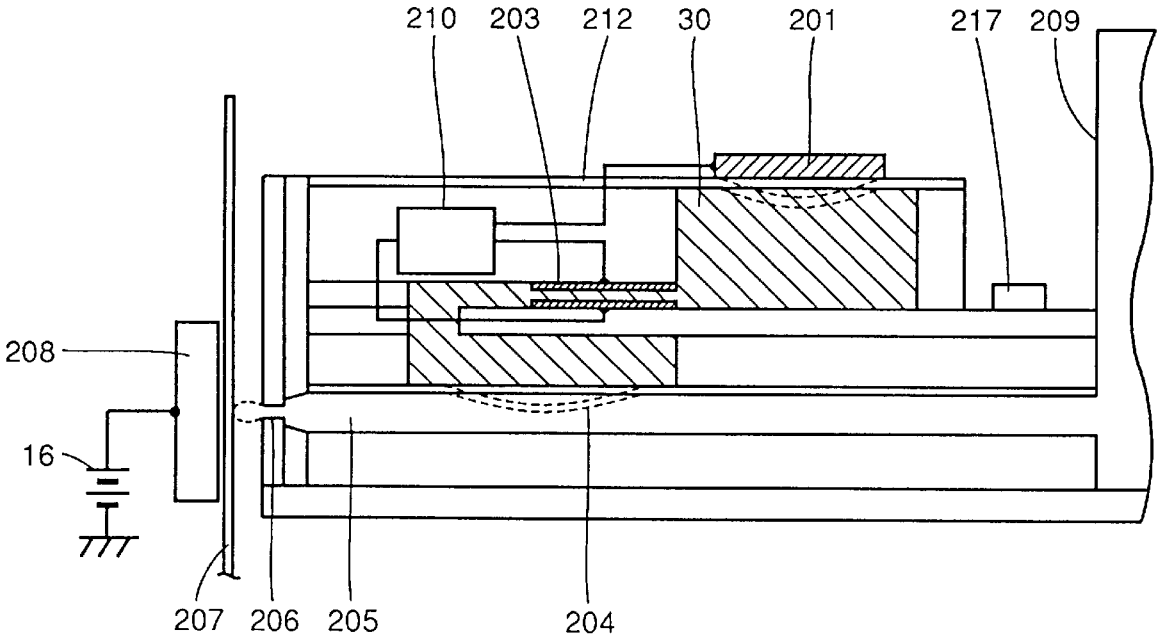
FIG. 25 is a partial sectional view of an ink jet head according to the third embodiment.

Referring to FIG. 25, components corresponding to those of FIG. 24 have the same reference characters allotted, and their description will not be repeated. Piezo-electric element 201 for generating a discharge pressure is deformed as shown in the broken line in FIG. 25 as a result of application of a pulse voltage to the electrode attached by an epoxy adhesive agent to a stainless vibration plate of 0.1 mm in thickness. This deformation causes the generated pressure to be conveyed to ink flow path 205 via a film 204 with electroviscous fluid as a medium. Accordingly, ink is discharged from orifice 206. A pair of control electrodes 203 is provided at an appropriate position in the pressure transportation path. Piezo-electric element 201 and control electrodes 203 are controlled by control device 210.

Figure 26:
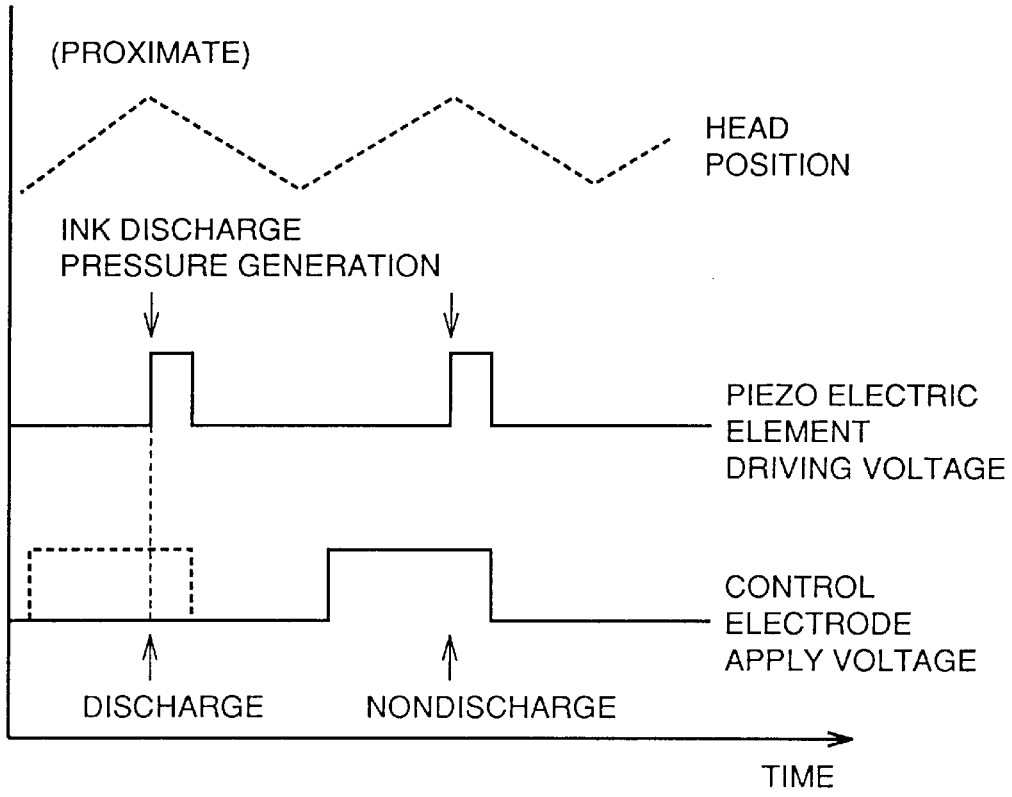
FIG. 26 is a timing chart of the recording head, the piezo-electric element driving voltage, and the control electrode apply voltage of the ink jet head of the third embodiment.

Referring to the timing chart of FIG. 26, a pulsive drive voltage is applied to piezo-electric element 201 at a printing timing conforming to the position of head 12. Also, voltage is applied to the pair of control electrodes 203 of a non-discharge ink channel to control adhesion of ink. Ink is discharged from the channel in which voltage is not applied to control electrodes 203, whereby information is recorded on the record medium.

Figure 27:
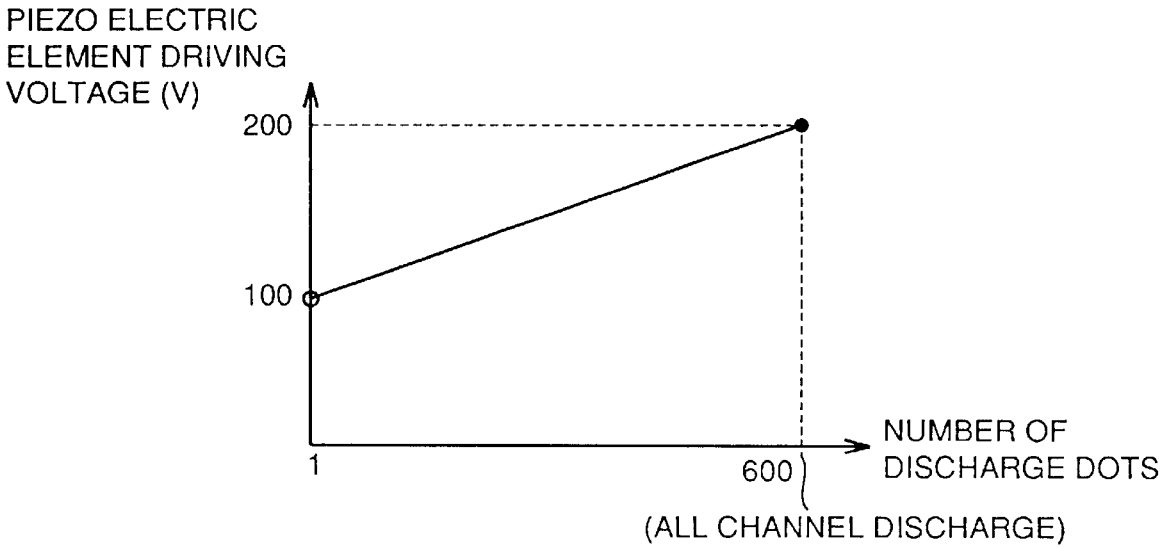
FIG. 27 is a graph showing the relationship between the number of discharge dots and the driving voltage of an electro-mechanical transducer of the ink jet head according to the third embodiment.

It is appreciated from FIG. 27 that the size of the ink droplets and the speed discharged from each channel are constant irrespective of the record pattern if the piezoelectric element driving voltage is increased linearly according to the number of discharge channels. Therefore, an image of a constant quality can be recorded. It is of course not necessary to drive the piezo-electric element when the number of discharge dots (the number of channels) is zero.

Figure 28:
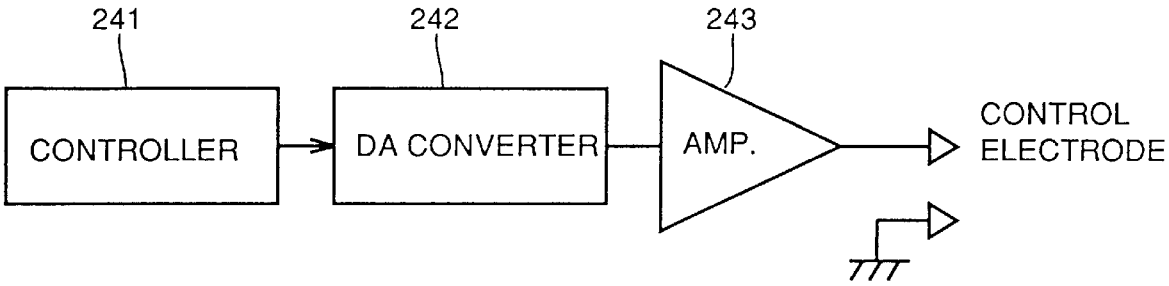
FIG. 28 is a block diagram of a control driving circuit of the ink jet head according to the third embodiment.

Referring to FIG. 28, a digital signal from a controller 241 is converted into an analog signal by a DA converter 242. The analog signal is amplified by an amplifier 243 to be applied to each control electrode 203.

Figure 29:
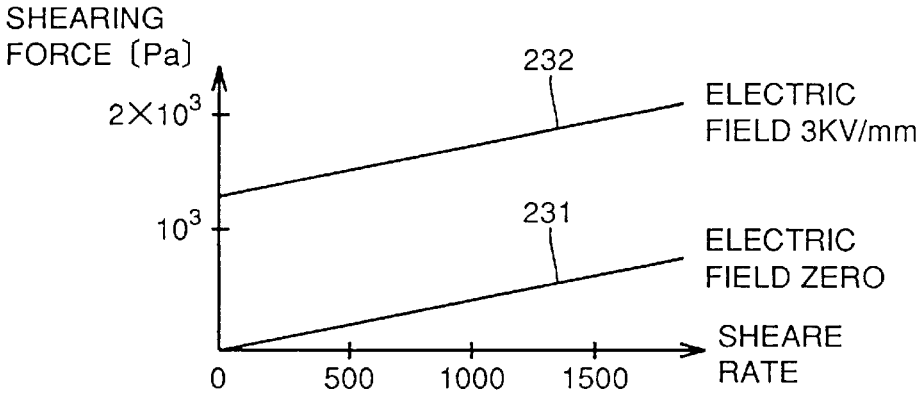
FIG. 29 is a graph showing the characteristics of the electroviscous fluid of the ink jet head according to the third embodiment.

Referring to FIG. 29, electroviscous fluid with graft polymer formed on the surface of carbon black particles as the dispersoid is used in the present embodiment. The gap between the electrodes is 30 microns, and the applied voltage is 100 V. The viscosity is represented by line 231 having a value of 25 mPa·sec when the electric field is zero. The viscosity is represented by line 232 having a value of 300 mpa·sec when an electric field is applied.

Referring to FIG. 25 again, urethane foam impregnated with ink is accommodated in a cartridge 209. The ink is supplied therefrom. Film 204 between ink flow path 205 and electroviscous fluid 30 is formed of an urethane sheet of 100 micron in thickness, and attached to the wall surface forming ink flow path 205. Ink discharge hole 206 is formed by having a water-repellent fluorine-contained resin plate irradiated with excimer laser.

The recording head produced as described above provided favorable printing results at the drive of 500 Hz under the aforementioned condition. The pulse width of the control voltage is 1 milliseconds. Spray out of ink commences by applying a voltage of 2 kv to electrode 208. Recording was possible even when the distance between the head and the recording medium is fixed to 1 mm.

Although all the structural members have been described in the present invention, it is to be noted that the required structural members differ between the case where ink is sprayed out and when ink is adhered by a pressing force. In the former case, cam mechanism 213, motor 214, and guide member 215 which are the mechanisms for moving recording head 212 backward and forward with respect to the surface of the record medium are not required. In the latter case, attraction electrode 208 is not required.

The present invention is not limited to the unimorph actuator having a piezo-electric element and a vibration plate attached as an electro-mechanical transducer. A transducer using a piezo-electric element, or an actuator taking advantage of vertical/horizontal deformation effects can be used. Alternatively, a magnetostriction element can be used.

As described above, a piezo-electric element generates a pressure wave towards electroviscous fluid. The control device responds to record information to control the plurality of electrode pairs individually, whereby the viscosity of the electroviscous fluid is altered. The generated pressure wave is transmitted or cut off by the electroviscous fluid to control the ink discharge from the orifice of respective ink flow paths.

By the pressure generation device provided common to the plurality of ink chambers, ink discharge from an orifice of a plurality of ink chambers can be controlled. Therefore, the head can be reduced in size without degrading favorable print out quality.

The generated pressure adjustment device adjusts the generated pressure wave to a lower level when the number of ink chambers that does not discharge ink is great. Therefore, ink can be discharged at a uniform pressure independent of the number of non-discharge heads.

Fourth Embodiment

Another embodiment of controlling ink discharge by applying pressure to electroviscous fluid will be described.

Figure 30:
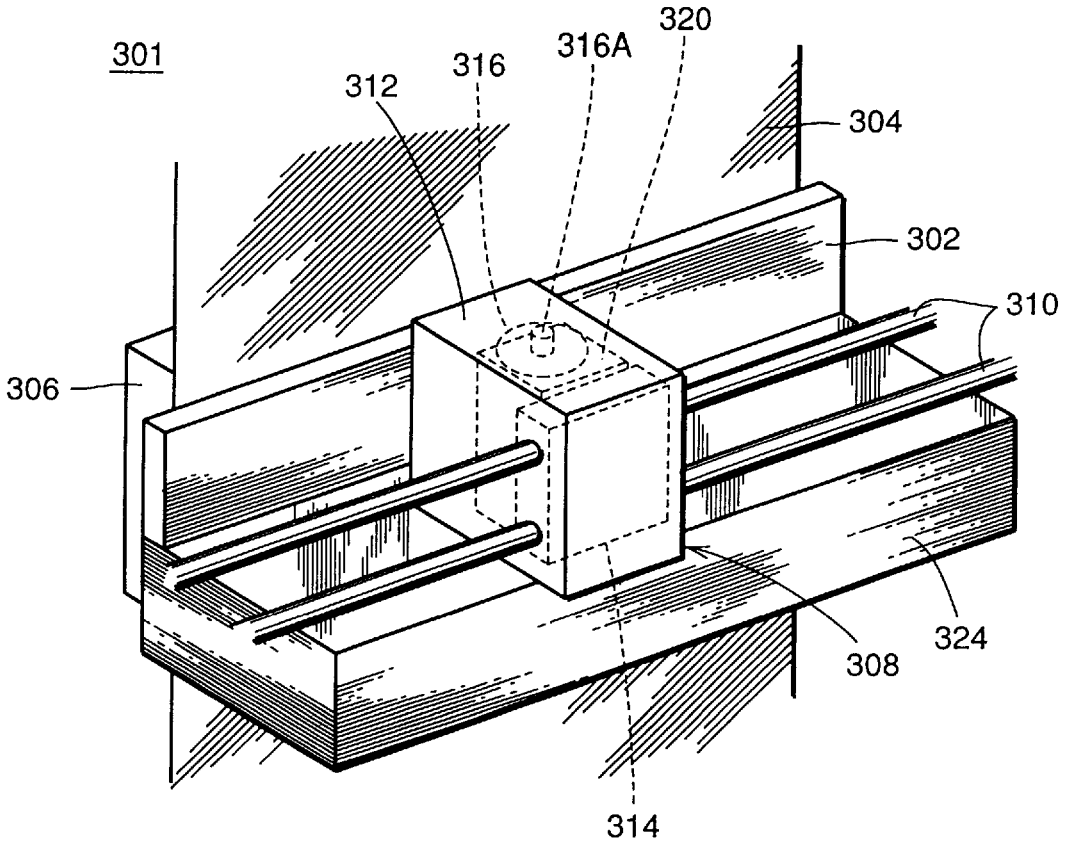
FIG. 30 is a perspective view of an entire ink jet head according to a fourth embodiment of the present invention.
Figure 31:
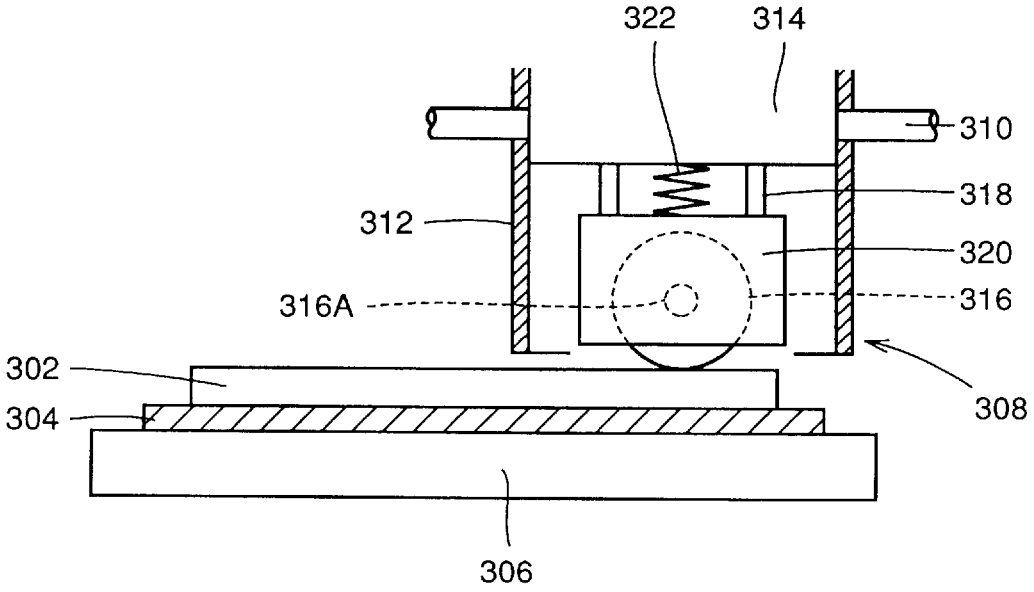
FIG. 31 is a plan view of the ink jet head of the fourth embodiment.

Referring to FIGS. 30 and 31, an ink jet head 301 according to the fourth embodiment includes a plate-like printing head 302. A rear plate 306 is disposed opposite to print head 302 so as to sandwich a record medium 304 such as a paper sheet in a parallel manner.

A carriage 308 is disposed at the side of print head 302 opposite to the side in contact with record medium 304. Carriage 308 is mounted to a pair of guide bar 310 in a slidable manner. Guide bar 310 is arranged at right angles to the feeding direction of record medium 304 (in the vertical direction in FIG. 30).

A movable body 314 and a pressure roller 316 as a pressure generation means are accommodated in a cover 312 having the side facing print head 302 opened. The pair of guide bars 310 penetrates movable body 314. A plurality of guide pins 318 are provided projecting towards print head 302. A support frame 320 is attached to guide pin 318 in a slidable manner. Respective ends of a shaft 316A of pressure roller 316 is supported on support frame 320. A compression spring 322 is provided between support frame 320 and movable unit 314. Compression spring 322 serves to bias pressure roller 316 towards print head 302 in an abutting manner through the opening of cover 312. The width of pressure roller 316 in the feeding direction is preset to be substantially equal to the width of print head 302. One operation of carriage 308 along guide bar 310 allows printing equal to the width of print head 302 on record medium 304. The next print out is effected after record medium 304 is forwarded by a width equal to print head 302.

An ink tank 324 is provided in ink jet head 301 to supply ink to print head 302.

Figure 32:
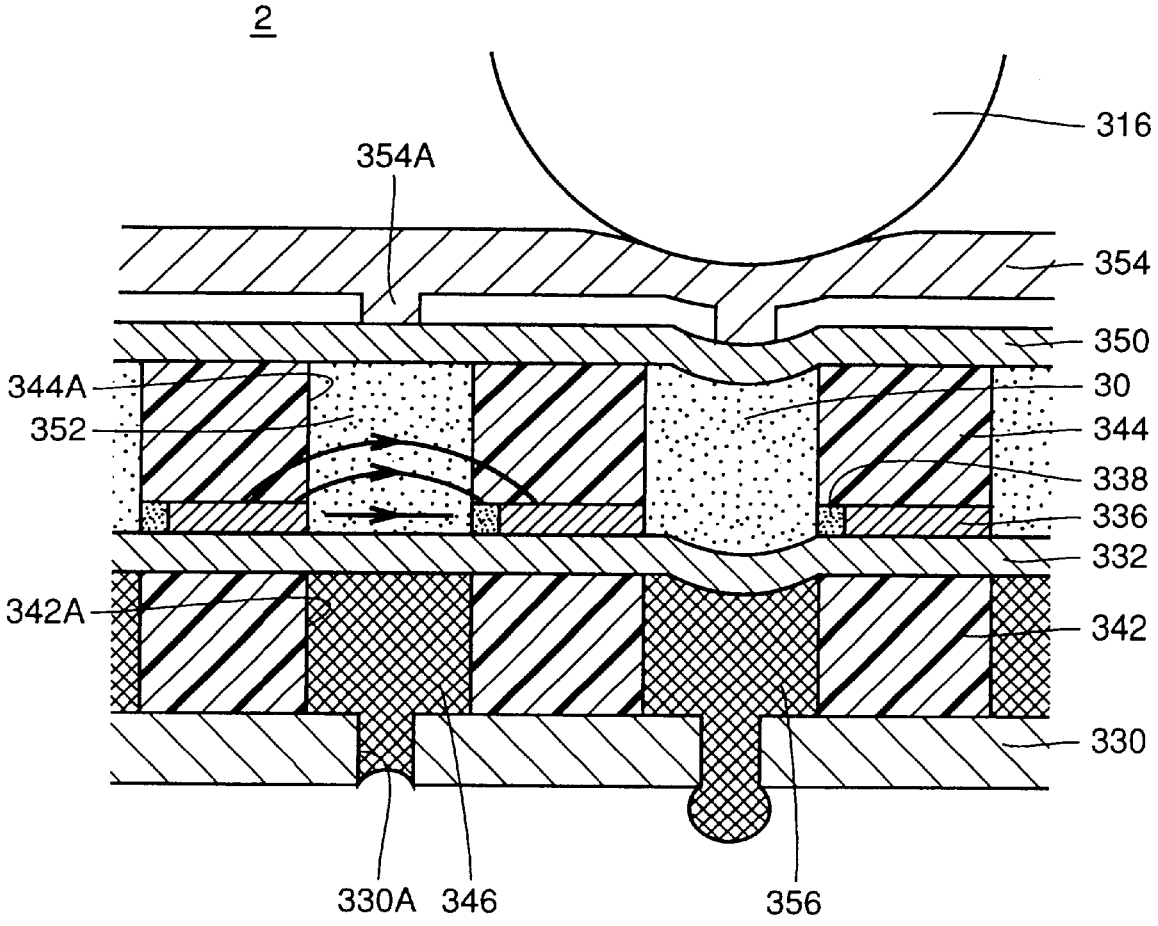
FIG. 32 is a sectional view of a print head portion of the ink jet head of the fourth embodiment.

Referring to FIG. 32, print head 302 includes an ink discharge sheet 330 and an electrode sheet 332. Ink discharge sheet 330 is formed of a polyimide resin sheet, for example. Ink discharge sheet 330 has an ink discharge hole 330A of approximately 100 microns in diameter by being irradiated with an excimer laser.

Electrode sheet 332 is formed of, for example, a polyimide resin sheet. A pair of electrodes 336 for altering the viscosity of electroviscous fluid 30 and a thin film transistor pair (for example, FET transistor) for controlling the applied voltage towards each electrode pair 336 are arranged in a two-dimensional matrix on electrode sheet 332. Each thin film transistor 338 is electrically connected to each other by a wire lead 340. The pair of thin film transistors 338 for controlling the applied voltage to electrode pair 336 is controlled by a control device 326 not shown.

A lower spacer 342 is provided between ink discharge sheet 330 and electrode sheet 332. An upper spacer 344 is provided above electrode sheet 332. A rectangular ink reservoir hole 342A and an ink supply path 342B (FIG. 33) communicating therewith are formed at lower spacer 342. A rectangular electroviscous fluid reservoir hole 344A is formed at upper spacer 344.

Figure 33:
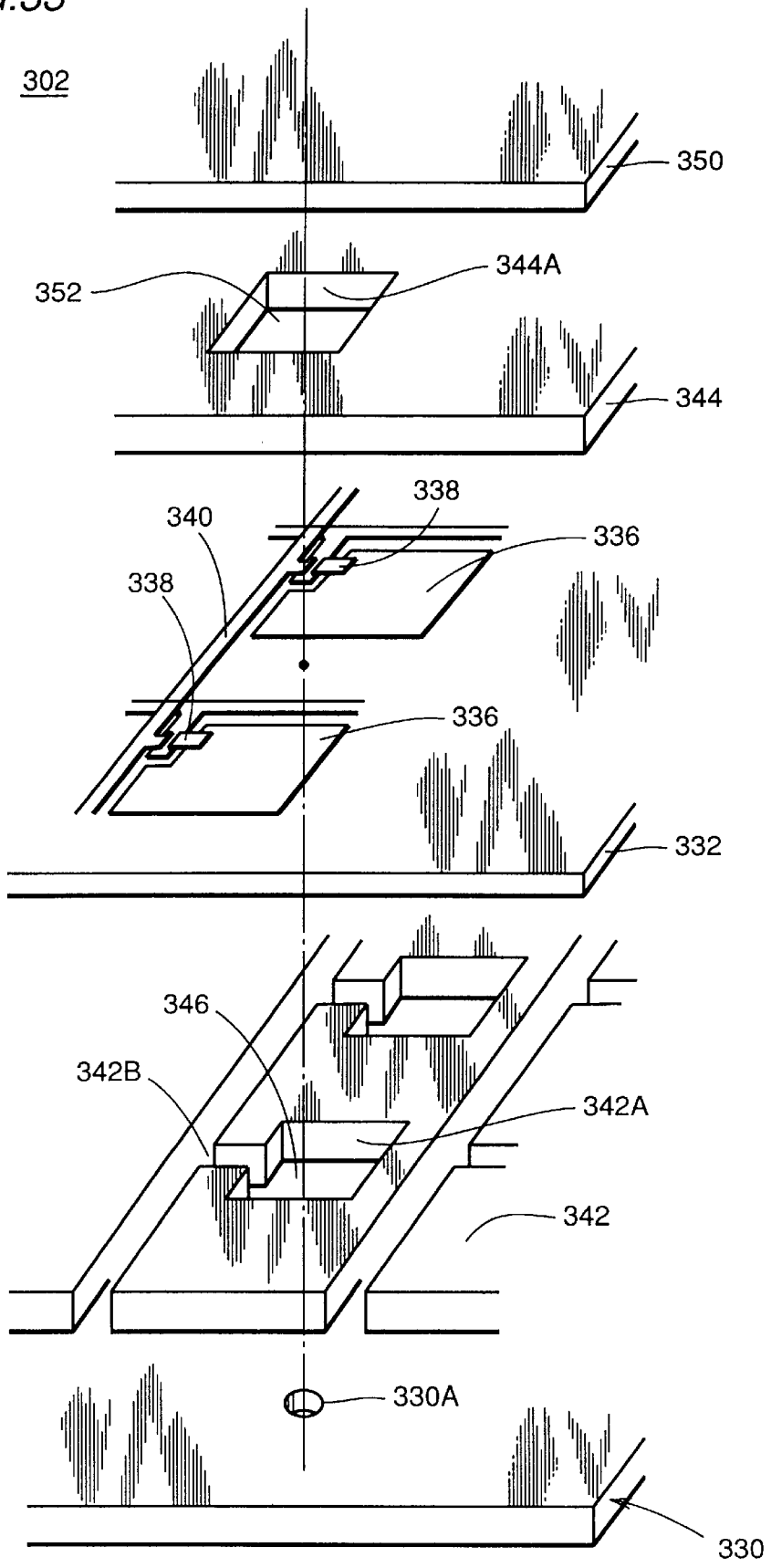
FIG. 33 is an exploded perspective view of the print head portion of the ink jet head according to the fourth embodiment of the present invention.

Referring to FIG. 33, each ink reservoir hole 342A and electroviscous fluid reservoir hole 344A are positioned between electrodes 336, and so as to be aligned with ink discharge hole 330A.

Ink reservoir hole 342A, ink supply path 342B, and electroviscous fluid reservoir hole 344A provided at upper and lower spacers 342 and 344 are formed by, for example, laminating a dry film for photosensitive adhesion on both the top and bottom surfaces of electrode sheet 342 after electrode pair 336 and thin film transistor pair 338 are formed, and subjecting the dry film to pattern exposure and development.

Ink discharge sheet 330 and electrode sheet 332 are fixed sandwiching lower spacer 342. Ink reservoir chamber 346 is formed by the portion surrounded by the perimeter wall of ink reservoir hole 342 of lower spacer 342 and upper and lower sheets 330 and 332. Each ink reservoir chamber 346 communicates with ink tank 324 via ink supply path 342B.

Each electroviscous fluid reservoir hole 344A in upper spacer 344 is filled with electroviscous fluid 30. A flexible plate 350 formed of polyimide resin or the like is attached on the top surface of upper spacer 344 so as to seal electroviscous fluid reservoir hole 344A.

Electrode sheet 332 and flexible plate 350 are fixed sandwiching upper spacer 344. A pressure transmission cell 352 in which electroviscous fluid 348 is sealed is formed by the portion surrounded by the circumferential wall of electroviscous fluid reservoir hole 344A of upper spacer 344, electrode sheet 332, and flexible plate 350. Pressure transmission cell 352 is not limited to that of the present embodiment, and an arbitrary structure is allowed as long as electroviscous fluid 30 is sealed.

In print head 302 of the present embodiment, respective pressure transmission cells 352 are arranged individually above ink reservoir chamber 342 in a corresponding manner. A pair of electrodes 336 is arranged for each pressure transmission cell 352.

A product such as TX-ER6 of Nippon Shokubai Co., Ltd. can be used for electroviscous fluid 30.

FIGS. 32 and 33 also depicts a pressure receiving plate 354 formed of plastic or metal mounted above flexible plate 350. Pressure receiving plate 354 includes a projection 354A provided at the side of pressure transmission cell 352. Projection 354A has a diameter smaller than the width of the cell in a direction orthogonal to the pressure receiving direction of pressure transmission cell 352 (corresponding to hole diameter of electroviscous fluid reservoir hole 344A in the present invention). Pressure roller 316 is in contact with the top surface of pressure-receiving plate 354.

In ink jet head 301 of the above-described structure, ink is drawn up by the capillary phenomenon from ink tank 324 to be stored in ink reservoir chamber 346 via ink supply path 342B.

By operating carriage 308 to move pressure roller 316 in the longitudinal direction of print head 302 in a rotating manner, projection 354A of pressure-receiving plate 354 in contact with pressure roller 316 is urged towards flexible plate 350 by the pressure force of pressure roller 316. This pressing force is transmitted to pressure transmission cell 352.

When voltage is not applied across a pair of electrodes 336 sandwiching a certain pressure transmission cell 352, the pressing force by pressure roller 316 is conveyed to ink 352 stored in ink reservoir chamber 346 via pressure transmission cell 352 and electrode sheet 332 since the viscosity of electroviscous fluid 30 is low. As a result, ink is discharged from ink discharge hole 330A to effect printing on record medium 304.

During this printing operation, ink supply path 342B is depressed by the pressing force from pressure roller 316 to become narrower. Therefore, the back flow towards ink tank 324 can be reduced.

When thin film transistors 338 sandwiching a certain pressure transmission cell 352 is turned on and voltage is applied across electrodes 336, the viscosity of electroviscous fluid 348 sealed within that pressure transmission cell 352 is increased. As a result, the pressing force from pressure roller 316 is not sufficiently conveyed to ink 356 stored in ink reservoir chamber 342, whereby discharge of ink 356 from ink discharge hole 330A is suppressed. Therefore, no printing is carried out on record medium 304.

ON/OFF control of thin film transistor pair 338 is provided according to record information by control device 326 not shown to apply or suppress voltage across electrodes 336 in close proximity to each pressure transmission cell 352, so that print out can be carried out arbitrarily according to the record information onto record medium 304.

Although pressure roller 316 is used as a pressure generation device in the present embodiment, a press device that provides pressure all over print head 302 at one time can be used. In the present embodiment, print head 302 has pressure transmission cell 352 and neighboring electrode pairs 336 arranged in a two-dimensional matrix. Alternatively, a structure arranged in a line manner can be applied.

Thus, a pressure roller is provided adjacent to a pressure transmission cell to generate a pressure wave in the pressure transmission cell to the electroviscous fluid. The control device responds to record information to control independently a plurality of electrode pairs to alter the viscosity of the electroviscous fluid. The pressure wave generated in the pressure transmission cell is transmitted or cut off by the electroviscous fluid. Thus, ink discharge from the ink discharge hole of a plurality of ink reservoir holes can be controlled.

By the pressure roller provided common to the plurality of ink reservoir chambers, the ink discharge from respective ink discharge holes of the plurality of ink reservoir chambers can be controlled. As a result, the head can be reduced in size without degradation of the favorable print out quality.

The pressure roller provided opposite to the plurality of ink reservoir chambers about the plurality of pressure transmission cells applies pressure to the electroviscous fluid of the plurality of pressure transmission cells. The electroviscous fluid within the plurality of pressure transmission cells arranged in a two-dimensional matrix receives uniform pressure by the pressure roller.

Therefore, difference in the print out density will not occur for a large print out area. Print out of a favorable quality can be achieved. Since a pressure roller is more economic in contrast to an electrical device, the cost of the ink jet head can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet head comprising:

an ink chamber including an orifice for discharging ink;

an ink supply path operatively connected to said ink chamber for supplying ink to said ink chamber, said ink chamber including a sidewall;

an electroviscous fluid chamber located at a part of said sidewall of said ink chamber, and in which electroviscous fluid is sealed, an elastic film located between said ink chamber and said electroviscous fluid chamber for transmitting pressure between said ink chamber and said electroviscous fluid chamber, a pair of electrodes provided at a part of the sidewall of said electroviscous fluid chamber corresponding to said ink chamber for applying and electric field to said electroviscous fluid when voltage is applied to the electrodes, means for generating pressure operatively connected to said ink chamber for discharging ink from said ink chamber, and means for controlling ink discharge from said orifice operatively connected to the electrodes, by applying a voltage to said pair of electrodes in response to record information to alter viscosity of said electroviscous fluid.

2. The ink jet head according to claim 1, comprising a plurality of said ink chambers, and a plurality of said pair of electrodes provided corresponding to said plurality of ink chambers, wherein said ink supply path supplies ink to said plurality of ink chambers, and said means for controlling said plurality of pairs of electrodes controls each pair individually.

3. The ink jet head according to claim 2, further comprising an ink pressure chamber for supplying ink from said ink supply path to said plurality of ink chambers, said ink pressure chamber operatively connected to said ink supply path and said plurality of ink chambers wherein said means for generating pressure is provided adjacent to and operatively connected to said ink pressure chamber for generating a pressure wave to ink within said ink pressure chamber, wherein said means for controlling responds to said record information to control said plurality of pairs of electrodes individually to alter viscosity of said electroviscous fluid, whereby a pressure wave generated at said ink pressure chamber is reflected or absorbed by said electroviscous fluid for controlling ink discharge from an orifice of respective plurality of ink chambers.

4. The ink jet head according to claim 3, wherein said means for generating pressure comprises an electromechanical transducer provided adjacent to said ink pressure chamber for electrically converting electrical displacement into mechanical displacement to depress ink for generating a pressure wave.

5. The ink jet head according to claim 4, wherein said electro-mechanical transducer generates a pressure wave utilizing deflection of the transducer.

6. The ink jet head according to claim 4, wherein said electromechanical transducer generates a pressure wave utilizing extension/contraction of the transducer.

7. The ink jet head according to claim 3, wherein said pressure generation means comprises an electro thermal exchanger provided adjacent to said ink pressure chamber for converting electrical displacement into thermal energy to generate a pressure wave by heating ink.

8. The ink jet head according to claim 3, wherein said pressure generation means is provided common to said plurality of ink chambers.

9. The ink jet head according to claim 3, comprising a plurality of said pressure generation means, wherein said plurality of ink chambers is divided into a plurality of groups of ink chambers, wherein said plurality of pressure generation means is provided corresponding to said plurality of groups of ink chambers.

10. The ink jet head according to claim 3, wherein said electroviscous fluid chamber comprises pressure absorption means provided at a side of said electroviscous fluid chamber not in contact with said ink chamber for absorbing a pressure wave generated at said ink pressure chamber that is absorbed by said electroviscous fluid.

11. The ink jet head according to claim 10, wherein said pressure absorption means comprises a film provided at a side of said electroviscous fluid chamber not in contact with said ink chamber for emitting pressure in said electroviscous fluid chamber to the atmosphere.

12. The ink jet head according to claim 10, wherein said pressure absorption means comprises an air chamber provided at a side of said electroviscous fluid chamber not in contact with said ink chamber for absorbing pressure within said electroviscous fluid chamber.

13. The ink jet head according to claim 10, wherein said pressure absorption means includes a pressure absorption member provided at a side of said ink chamber not in contact with said electroviscous fluid chamber for absorbing pressure in said electroviscous fluid chamber.

14. The ink jet head according to claim 3, wherein said electroviscous fluid chamber is provided common to said plurality of ink chambers.

15. The ink jet head according to claim 3, comprising a plurality of said electroviscous fluid chambers provided corresponding to said plurality of ink chambers respectively.

16. The ink jet head according to claim 3, comprising a plurality of said electroviscous fluid chambers, wherein said plurality of ink chambers is divided into a plurality of groups of ink chambers, and said plurality of electroviscous fluid chambers is provided corresponding to each group of said plurality of groups of ink chambers.

17. The ink jet head according to claim 3, further comprising:

a first flow path member provided between said ink pressure chamber and said plurality of ink chambers, and a second flow path member provided between said ink pressure chamber and said ink supply path, wherein said first flow path member has a resistance smaller than a resistance of said second flow path member.

18. The ink jet head according to claim 2, wherein said pressure generation means is provided adjacent to said electroviscous fluid chamber for generating a pressure wave to said electroviscous fluid within said electroviscous fluid chamber, wherein said control means alters viscosity of said electroviscous fluid chamber by controlling individually said plurality of pairs of electrodes in response to said record information to transmit or cut off the pressure wave generated at said electroviscous fluid chamber by said electroviscous fluid for controlling ink discharge from an orifice of respective plurality of ink chambers.

19. The ink jet head according to claim 18, wherein said electroviscous fluid chamber comprises pressure absorption means provided at a side of said electroviscous fluid chamber not in contact with said ink chamber for absorbing a pressure wave generated at said electroviscous fluid chamber that is absorbed by said electroviscous fluid.

20. The ink jet head according to claim 19, wherein said pressure generation means comprises an electro-mechanical transducer provided adjacent to said electroviscous fluid chamber for converting electrical displacement into mechanical displacement to generate a pressure wave by depressing said electroviscous fluid.

21. The ink jet head according to claim 20, wherein said electromechanical transducer generates a pressure wave utilizing deflection of the transducer.

22. The ink jet head according to claim 20, wherein said electro-mechanical transducer generates a pressure wave utilizing extension/contraction of the transducer.

23. The ink jet head according to claim 19, wherein said pressure generation means comprises an electro thermal exchanger provided adjacent to said electroviscous fluid chamber for converting electrical displacement into thermal energy to generate a pressure wave by heating said electroviscous fluid.

24. The ink jet head according to claim 19, wherein said pressure generation means is provided common to said plurality of ink chambers.

25. The ink jet head according to claim 19, comprising a plurality of said pressure generation means, wherein said plurality of ink chambers is divided into a plurality of groups of ink chambers, and wherein said plurality of pressure generation means is provided corresponding to said plurality of groups of ink chambers.

26. The ink jet head according to claim 19, wherein said pressure absorption means comprises a film provided at a side of said electroviscous fluid chamber not in contact with said ink chamber for emitting a pressure in said electroviscous fluid chamber to the atmosphere.

27. The ink jet head according to claim 19, wherein said pressure absorption means comprises an air chamber provided at a side of said electroviscous fluid chamber not in contact with said ink chamber for absorbing pressure within said electroviscous fluid chamber.

28. The ink jet head according to claim 19, wherein said pressure absorption means comprises a pressure absorption member provided at a side of said electroviscous fluid chamber not in contact with said ink chamber for absorbing pressure in said electroviscous fluid chamber.

29. The ink jet head according to claim 19, where said electroviscous fluid chamber is provided common to said plurality of ink chambers.

30. The ink jet head according to claim 19, comprising a plurality of said electroviscous fluid chambers provided corresponding to said plurality of ink chambers respectively.

31. The ink jet head according to claim 19, comprising a plurality of said electroviscous fluid chambers, wherein said plurality of ink chambers is divided into a plurality of groups of ink chambers, and wherein said plurality of electroviscous fluid chambers is provided corresponding to each group of said plurality of groups of ink chambers.

32. The ink jet head according to claim 18, further comprising generation pressure adjustment means for adjusting a level of a pressure wave generated by said pressure generation means according to said record information.

33. The ink jet head according to claim 32, further comprising distance control means for controlling distance between said ink jet head and a record medium in cooperation with an operation of said pressure generation means.

34. The ink jet head according to claim 32, wherein said electroviscous fluid comprises a carbon black particle having graft polymer formed at its surface as a dispersoid.

35. The ink jet head according to claim 32, wherein said pressure generation means comprises an electro-mechanical transducer provided adjacent to said electroviscous fluid chamber for converting electrical displacement into mechanical displacement to generate a pressure wave by depressing said electroviscous fluid.

36. The ink jet head according to claim 35, wherein said electro-mechanical transducer enerates a pressure wave utilizing deflection of the transducer.

37. The ink jet head according to claim 35, wherein said electromechanical transducer generates a pressure wave utilizing extension/contraction of the transducer.

38. The ink jet head according to claim 32, wherein said pressure generation means comprises an electro thermal exchanger provided adjacent to said electroviscous fluid chamber for converting electrical displacement into thermal energy for generating a pressure wave by heating said electroviscous fluid.

39. The ink jet head according to claim 32, wherein said pressure generation means is provided common to said plurality of ink chambers.

40. The ink jet head according to claim 32, comprising a plurality of said pressure generation means, wherein said plurality of ink chambers is divided into a plurality of groups of ink chambers, and wherein said plurality of pressure generation means is provided corresponding to said plurality of groups of ink chambers.

41. The ink jet head according to claim 32, wherein said electroviscous fluid chamber is provided common to said plurality of ink chambers.

42. The ink jet head according to claim 32, comprising a plurality of said electroviscous fluid chambers provided corresponding to said plurality of ink chambers respectively.

43. The ink jet head according to claim 32, comprising a plurality of said electroviscous fluid chambers, wherein said plurality of ink chambers is divided into a plurality of groups of ink chambers, and wherein said plurality of electroviscous fluid chambers is provided corresponding to each group of said plurality of groups of ink chambers.

44. The ink jet head according to claim 18, comprising a plurality of said electroviscous fluid chambers provided corresponding to said plurality of ink chambers respectively, wherein an electrode of each of said plurality of pairs of electrodes is provided at a wall surface of said plurality of electroviscous fluid chambers opposite to a side adjacent to said plurality of ink chambers, wherein said pressure generation means is provided opposite to said plurality of ink chambers about said plurality of electroviscous fluid chambers.

45. The ink jet head according to claim 44, wherein said plurality of ink chambers and said plurality of electroviscous fluid chambers corresponding to said plurality of ink chambers are arranged in a two-dimensional matrix.

46. The ink jet head according to claim 44, further comprising a plurality of control elements provided corresponding to said plurality of electroviscous fluid chambers for controlling applied voltage to said pair of electrodes.

47. The ink jet head according to claim 44, wherein said pressure generation means comprises a roller provided opposite to said plurality of ink chambers about said plurality of electroviscous fluid chambers for applying a pressure to said electroviscous fluid.

48. The ink jet head according to claim 44, further comprising a pressure-receiving plate provided between said pressure generation means and said electroviscous fluid chamber for transmitting pressure generated by said pressure generation means to said plurality of electroviscous fluid chambers.

49. The ink jet head according to claim 44, wherein said pressure-receiving plate comprises a flat plate for receiving pressure generated by said pressure generation means, and a projection provided towards said electroviscous fluid chamber and having a diameter smaller than a width of said electroviscous fluid chamber for transmitting pressure generated by said pressure generation means to said electroviscous fluid chamber.

* * * * *